US009812313B2

(12) United States Patent
Grothe, Jr.

(10) Patent No.: US 9,812,313 B2
(45) Date of Patent: Nov. 7, 2017

(54) TIME-OF-FLIGHT ANALYSIS OF A CONTINUOUS BEAM OF IONS BY A DETECTOR ARRAY

(71) Applicant: DH Technologies Development Pte. Ltd., Singapore (SG)

(72) Inventor: Robert Alois Grothe, Jr., Campbell, CA (US)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/105,089

(22) PCT Filed: Dec. 6, 2014

(86) PCT No.: PCT/IB2014/002684
§ 371 (c)(1),
(2) Date: Jun. 16, 2016

(87) PCT Pub. No.: WO2015/101820
PCT Pub. Date: Jul. 9, 2015

(65) Prior Publication Data

US 2016/0336161 A1 Nov. 17, 2016

Related U.S. Application Data

(60) Provisional application No. 61/922,696, filed on Dec. 31, 2013.

(51) Int. Cl.
*H01J 49/00* (2006.01)
*H01J 49/40* (2006.01)
(Continued)

(52) U.S. Cl.
CPC ..... *H01J 49/40* (2013.01); *H01J 49/0031* (2013.01); *H01J 49/025* (2013.01); *H01J 49/20* (2013.01); *H01J 49/22* (2013.01)

(58) Field of Classification Search
CPC ..... H01J 49/00; H01J 49/02; H01J 49/025; H01J 49/06; H01J 49/061; H01J 49/20;
(Continued)

(56) References Cited

U.S. PATENT DOCUMENTS 7,388,196 B1 * 6/2008 Hagerman ..... H01J 49/421 250/281
7,696,474 B2 * 4/2010 Wu ..... G01N 27/624 250/281
(Continued)

OTHER PUBLICATIONS

International Search Report and Written Opinion for PCT/IB2014/002684, mailed Apr. 9, 2015.
(Continued)

*Primary Examiner* — Jason McCormack
(74) *Attorney, Agent, or Firm* — John R. Kasha; Kelly L. Kasha; Kasha Law LLC

(57) ABSTRACT

Systems and methods are provided for time-of-flight analysis of a continuous beam of ions by a detector array. A sample is ionized using an ion source to produce a continuous beam of ions. An electric field is applied to the continuous beam of ions using an accelerator to produce an accelerated beam of ions. A rotating magnetic and/or electric field is applied to the accelerated beam to separate ions with different mass-to-charge ratios over an area of a two-dimensional detector using a deflector located between the accelerator and the two-dimensional detector. An arrival time and a two-dimensional arrival position of each ion of the accelerated beam are recorded using the two-dimensional detector. Alternatively, an electric field that is periodic with time is applied in order to sweep the accelerated beam over a periodically repeating path on the two-dimensional rectangular detector.

17 Claims, 14 Drawing Sheets

(51) Int. Cl.
*H01J 49/02* (2006.01)
*H01J 49/20* (2006.01)
*H01J 49/22* (2006.01)

(58) Field of Classification Search
CPC ..... H01J 49/36; H01J 49/40; H01J 49/408; H01J 49/424; H01J 49/426
USPC ..... 250/281, 282, 283, 286, 287, 290, 291, 250/293, 298, 299
See application file for complete search history.

(56) References Cited

U.S. PATENT DOCUMENTS

| | | | | |
|---|---|---|---|---|
| 2003/0168588 | A1 | 9/2003 | Brailove et al. | |
| 2005/0017166 | A1 | 1/2005 | Scheidemann et al. | |
| 2006/0011828 | A1* | 1/2006 | Livi ..... | H01J 49/061 250/288 |
| 2006/0017010 | A1* | 1/2006 | Vanderberg ..... | G21K 1/093 250/492.1 |
| 2006/0138316 | A1 | 6/2006 | Seydoux et al. | |
| 2012/0112060 | A1* | 5/2012 | Kinugawa ..... | H01J 49/408 250/287 |

OTHER PUBLICATIONS

E. E. Hays, et al. "Mass Measurements with a Magnetic Time-of-Flight Mass Spectrometer," Nov. 15, 1951, pp. 824-825.

* cited by examiner

200

300

500

600

1000

1100

1200

1300

TIME-OF-FLIGHT ANALYSIS OF A CONTINUOUS BEAM OF IONS BY A DETECTOR ARRAY

CROSS REFERENCE TO RELATED APPLICATION

This application claims the benefit of U.S. Provisional Patent Application Ser. No. 61/922,696, filed Dec. 31, 2013, the content of which is incorporated by reference herein in its entirety.

INTRODUCTION

A key problem in current time-of-flight mass spectrometers (TOF MS) is inadequate detector capacity. Inadequate detector capacity manifests itself in two ways: 1) detector saturation by individual ion species; 2) artifacts in the mass spectrum caused by two or more ion species with very small differences in their mass-to-charge ratios, including distortions in the observed intensities or m/z values, spurious merging of distinct m/z values, or complete loss of some ion species that arrive at the detector at nearly the same time because of their small differences in mass-to-charge ratio.

The primary cause of detector saturation in existing TOF MS analyzers is that ions are bunched into packets and sent in pulses toward a single detector. Ions representing a wide range of mass-to-charge (m/z) ratios spread out as they fly toward the detector—ions with smaller m/z flying faster and arriving at the detector sooner. The spreading of ions makes it easier for the detector to record arriving ions by reducing the frequency of coincident or nearly coincident arrivals.

If the m/z values of ions were distributed uniformly over the mass spectrum, detection problems arising from pulsed ion transmission would be eliminated by the axial spreading of ions as they fly to the detector. Unfortunately, the m/z values of ions are not uniformly distributed; instead, mass spectra consist of discrete impulses. Ions represent distinct m/z values as they are comprised of distinct elemental compositions. Macroscopic populations of ions will have exactly the same m/z value. In addition, ions with the same nominal mass are bunched together by virtue of the nearly integer values of the masses of their atomic constituents. Pulsed transmission of ions, whose m/z values are inherently bunched together, leads to spikes of ions arriving at nearly the same time. These spikes of ions, together with intense ion sources, provide extremely challenging conditions for ion detection that current detectors cannot handle. In existing commercial TOF MS instruments, problems related to insufficient detector capacity can be prevented by attenuating the beam of ions produced by a continuous ion source by rapidly switching a lens between two voltage settings that alternately admit and block ions. The fraction of ions produced by the ion source that pass through the attenuating lens is called the ion transmission coefficient (ITC). ITC values of 0.01 to 0.1 are frequently used in MS-I analysis, indicating that the detector capacity is 10-100 lower than what is required to analyze the output of the ion source without attenuation.

Although detector saturation is prevented by attenuating the beam, quantification accuracy for low-abundance species is severely compromised in MS-I analysis. Many low-abundance analytes may not be detected at all. Even for samples that have low dynamic range in the relative abundances of their analytes, analytic throughput is reduced in proportion to the fraction of ions that are wasted by partially blocking the beam.

SUMMARY

A time-of-flight mass (TOF) spectrometer is disclosed for analyzing a continuous beam of ions using a rotating magnetic field. The TOF spectrometer includes an ion source, an accelerator, a two-dimensional detector, and a deflector. The ion source ionizes a sample producing a continuous beam of ions. The accelerator receives the continuous beam and applies an electric field to the continuous beam of ions producing an accelerated beam of ions. The two-dimensional detector records an arrival time and a two-dimensional arrival position of each ion of the accelerated beam impacting the two-dimensional detector. The deflector is located between the accelerator and the two-dimensional detector. The deflector receives the accelerated beam and applies a rotating magnetic field to the accelerated beam to separate ions with different mass-to-charge ratios in the accelerated beam over an area of the two-dimensional detector.

A method is disclosed for analyzing the time-of-flight of a continuous beam of ions using a rotating magnetic field. A sample is ionized using an ion source to produce a continuous beam of ions. An electric field is applied to the continuous beam of ions using an accelerator to produce an accelerated beam of ions. A rotating magnetic field is applied to the accelerated beam to separate ions with different mass-to-charge ratios in the accelerated beam over an area of a two-dimensional detector using a deflector located between the accelerator and the two-dimensional detector. An arrival time and a two-dimensional arrival position of each ion of the accelerated beam are recorded using the two-dimensional detector.

A TOF spectrometer is disclosed for analyzing a continuous beam of ions that optimizes the utilization of the area of a rectangular detector. The TOF spectrometer includes an ion source, a mass filter, an accelerator, a two-dimensional rectangular detector, and a deflector. The ion source ionizes a sample producing a continuous beam of ions. The mass filter receives the continuous beam and admits ions with a desired range of mass-to-charge ratios and blocks ions outside the desired range producing a filtered beam of ions. The accelerator receives the filtered beam and applies an electric field to the continuous beam of ions producing an accelerated beam of ions. The two-dimensional rectangular detector records an arrival time and a two-dimensional arrival position of each ion in the accelerated beam. The deflector is located between the accelerator and the two-dimensional rectangular detector. The deflector receives the accelerated beam and applies an electric field that is periodic with time to the accelerated beam in order to sweep the accelerated beam over a periodically repeating path on the two-dimensional rectangular detector.

The repeat period is set to the difference in the times required for ions with the highest and lowest mass-to-charge ratios in the filtered beam to travel from the deflector to the two-dimensional rectangular detector. The path has a maximum length among all paths that satisfies the following constraint. For any point x on the two-dimensional rectangular detector, the intersection between a circular region of diameter s centered about x and the path contains no more than one segment, where s denotes the diameter of the accelerated beam's cross section measured at the two-dimensional rectangular detector.

A method is disclosed for analyzing the time-of-flight of a continuous beam of ions that optimizes the utilization of the area of a rectangular detector. A sample is ionized using an ion source to produce a continuous beam of ions. Ions with a desired range of mass-to-charge ratios are admitted, and ions outside the desired range are blocked using a mass filter producing a filtered beam of ions. An electric field is applied to the filtered beam producing an accelerated beam of ions. An electric field that is periodic with time to the accelerated beam is applied in order to sweep the accelerated beam over a periodically repeating path on a two-dimensional rectangular detector using a deflector. An arrival time and a two-dimensional arrival position of each ion in the accelerated beam are recorded using the two-dimensional rectangular detector.

The repeat period is set to the difference in the times required for ions with the highest and lowest mass-to-charge ratios in the filtered beam to travel from the deflector to the two-dimensional rectangular detector. The path has a maximum length among all paths that satisfies the following constraint. For any point x on the two-dimensional rectangular detector, the intersection between a circular region of diameter s centered about x and the path contains no more than one segment, where s denotes the diameter of the accelerated beam's cross section measured at the two-dimensional rectangular detector.

A TOF spectrometer is disclosed for analyzing a continuous beam of ions using a rotating electric field. The TOF spectrometer includes an ion source, an accelerator, a two-dimensional detector, and a deflector. The ion source ionizes a sample producing a continuous beam of ions. The accelerator receives the continuous beam and applies an electric field to the continuous beam of ions producing an accelerated beam of ions. The two-dimensional detector records an arrival time and a two-dimensional arrival position of each ion of the accelerated beam impacting the two-dimensional detector. The deflector is located between the accelerator and the two-dimensional detector. The deflector receives the accelerated beam and applies a rotating electric field to the accelerated beam to separate ions with different mass-to-charge ratios in the accelerated beam over an area of the two-dimensional detector. The separation includes both a radial component and an angular component. Each component is a function of the mass-to-charge ratio of the ions.

A method is disclosed for analyzing the time-of-flight of a continuous beam of ions using a rotating electric field. A sample is ionized using an ion source to produce a continuous beam of ions. An electric field is applied to the continuous beam of ions using an accelerator to produce an accelerated beam of ions. A rotating electric field is applied to the accelerated beam to separate ions with different mass-to-charge ratios in the accelerated beam over an area of a two-dimensional detector using a deflector located between the accelerator and the two-dimensional detector where the separation includes both a radial component and an angular component. The radial component and the angular component are each a function of the mass-to-charge ratio of the separated ions. An arrival time and a two-dimensional arrival position of each ion of the accelerated beam are recorded using the two-dimensional detector.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Before one or more embodiments of the invention are described in detail, one skilled in the art will appreciate that the invention is not limited in its application to the details of construction, the arrangements of components, and the arrangement of steps set forth in the following detailed description or illustrated in the appendices. The invention is capable of other embodiments and of being practiced or being carried out in various ways. Also, it is to be understood that the phraseology and terminology used herein is for the purpose of description and should not be regarded as limiting.

DESCRIPTION OF VARIOUS EMBODIMENTS

Computer-Implemented System

Figure 1:
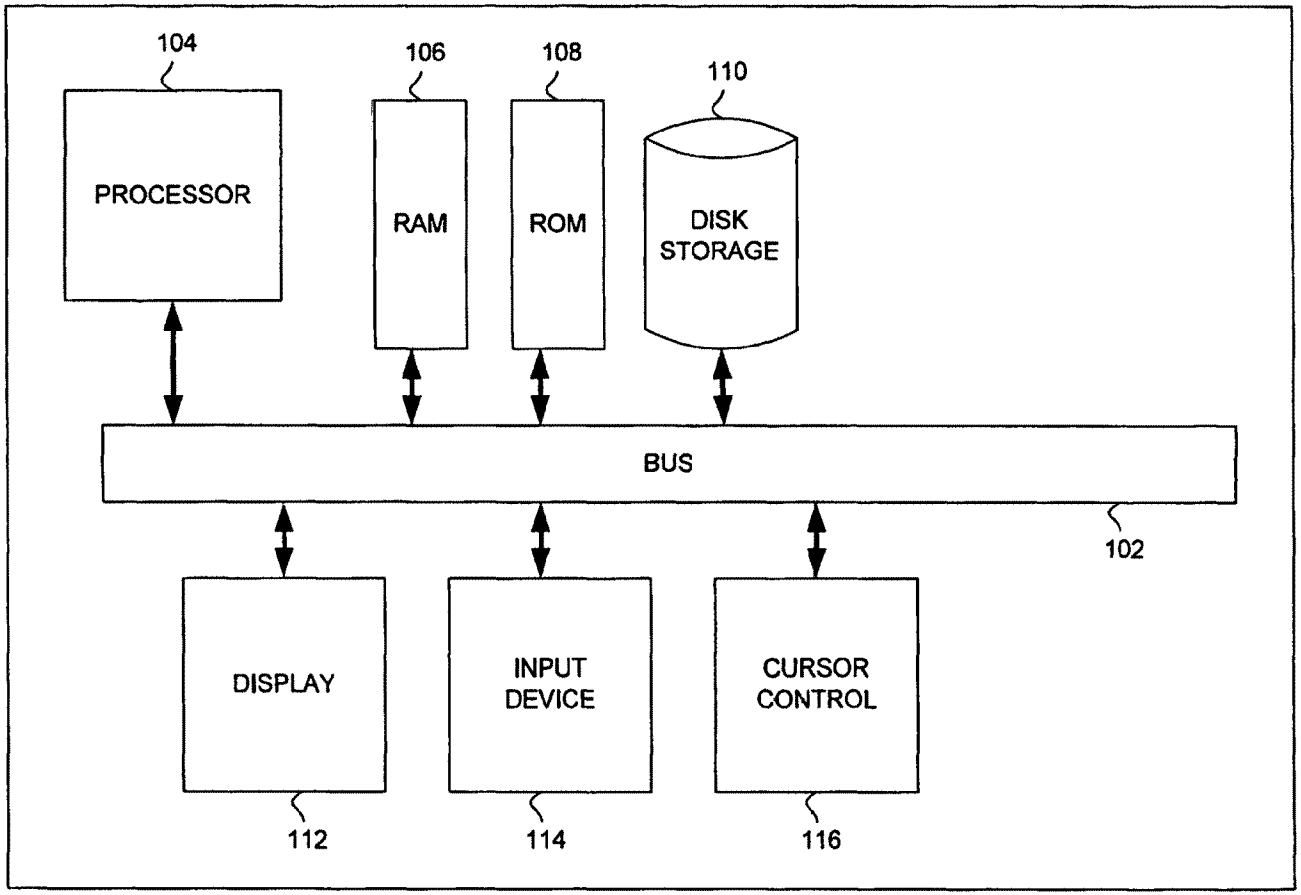
FIG. 1 is a block diagram that illustrates a computer system, upon which embodiments of the present teachings may be implemented.

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for Time-of-Flight Analysis

As described above, a key problem in current time-of-flight mass spectrometers (TOF MS) is inadequate detector capacity. Inadequate detector capacity manifests itself in two ways: 1) detector saturation by individual ion species; 2) artifacts in the mass spectrum caused by two or more ion species with very small differences in their mass-to-charge ratios, including distortions in the observed intensities or m/z values, spurious merging of distinct m/z values, or complete loss of some ion species that arrive at the detector at nearly the same time because of their small differences in mass-to-charge rat in.

In various embodiments, a focused ion beam is swept across an array detector in a periodically repeating pattern. The beam is swept across each individual detector element in the array so rapidly that the average ion flux is less than one ion per element per sweep. Thus, single ions can be analyzed by a simple time-to-digital converters (TDC) detector that records a single arrival time. By rapid sweeping, the position of each ion arrival indicates its departure time with high precision. In effect, each ion in a continuous beam is stamped with its departure time, eliminating the need for gating or pulsing.

Various embodiments are presented. In all embodiments, ions with different times of flight (measured from the deflector to the detector) are mapped to unique positions on the detector. It is important that each position is interpreted as a unique flight time. For practical purposes, the goal is to measure the largest range of flight times with the highest possible precision. Various embodiments that satisfy this goal are described herein.

Existing instruments can be modified to use the new analyzer designs by replacing the single detector with an array detector, modifying the ion optics to focus ions onto the detector, and adding a deflector element to rapidly sweep the ion beam onto the detector. The resulting modification improves sensitivity in MS-I mode by one to two orders of magnitude.

Delivering more ions to the detector allows the same analysis to be done faster; for many customers, time is money. Alternatively, lower limits of detection, improved quantitative accuracy, and/or lower sample usage are achieved when standard operating procedures are run on this new instrument. Increased dynamic range in MS-I allows a direct visualization of all precursors that contribute to an MS-2 scan, providing information that greatly facilitates accurate and comprehensive analysis of the MS-2 scan.

This aspect is especially beneficial in sequential windowed acquisition (SWATH). SWATH allows a mass range to be scanned within a time interval using multiple precursor ion scans of adjacent or overlapping precursor mass windows.

In various embodiments, methods and systems for time-of-flight analysis of a continuous beam of ions by a detector array provide MegaTOF mass spectrometry. A MegaTOF mass spectrometer is, for example, a time-of-flight mass spectrometer (TOF MS) in which a spatially focused, continuous, mono-energetic ion beam is rapidly swept across a position-sensitive detector by a time-dependent deflection field.

The name "MegaTOF" refers to the use of one million TDCs to perform time-of-flight analysis of ions in a massively parallel array. In various embodiments, there are actually 262 k detector elements—a 2×2 array of TimePix3 detector chips. Additional details about the TimePix3 detector are provided below.

The performance of various embodiments will benefit from future improvements in CMOS detector technology—in particular, arrays with over one million detector elements, increased communication bandwidth, and faster clocks to allow higher precision in measuring ion arrival times.

In TOF MS, the mass-to-charge ratio of each ion (m/z) is determined from the time it takes to fly to the detector from some defined starting line. In conventional TOF, ions are placed at a starting line and the time of departure corresponds to the application of an acceleration pulse. In MegaTOF, the starting line is the (center) position of a time-dependent deflector field. To allow time-of-flight analysis of a continuous beam in which ions depart asynchronously rather than in synchronous pulses, each ion is "time-stamped" with its departure time by means of the time-dependent deflector field. The position where the ion strikes the detector is governed by the time-dependent deflector field. Because the time profile of the deflector field is known, the position of the ion's arrival encodes the time at which the ion passed through the detector, i.e., its departure time.

At any given instant, ions representing a broad mass range, essentially the entire mass spectrum, are arriving at different positions on the detector. When all ions have the same axial kinetic energy, a lighter ion has a higher axial velocity than a heavier ion. So, if a lighter and a heavier ion reach the detector at the same time, the lighter ion left the "start line" later and caught up with the heavier ion just as both ions reached the "finish line", i.e., the detector.

Because the light and heavy ion passed through the deflection field at different times and because the field is changing with time, the ions are deflected to different positions. Because the deflection field changes continuously with time, and because the time-of-flight changes continuously with mass-to-charge ratio (m/z), a continuous mass spectrum of ions is mapped to a continuous arc on the detector, corresponding to the past positions of the deflector field. The lightest ions correspond to more recent positions of the deflector field, while successively heavier ions correspond to increasingly earlier positions of the deflector field.

In various embodiments, time-dependent fields "wrap" the mass spectrum (a line in general, or a line segment when a finite mass range is chosen) densely onto the (two-dimensional) area of the detector. The "image" of each distinct m/z value on the detector is a spot, whose size is determined by focusing the beam.

The performance of the mass analyzer is essentially governed by how many spots can be resolved within the detector array. If the spots are small, the linear mass spectrum can be wrapped tightly with close spacing between adjacent wrappings of the line. In addition, each spot casts a small shadow along the direction of the line. If the mapping is maximally dense, the number of resolvable spots is equal to available detection area divided by the size of each spot. If the mass range is wide, i.e., high mass/low mass >>1, the number of resolvable spots is roughly equal to the mass resolving power. The mass resolving power can be increased by analyzing a narrow mass range that excludes the lowest masses (i.e., 900-1000). Therefore, tight focusing of the beam and efficient use of the detector area are necessary to achieve high resolving power over a wide mass range.

In various embodiments, this mass analyzer can be operated with a duty cycle of 100% over the selected mass range: every ion produced by the source is detected and mass analyzed. Many key mass spectrometry metrics are limited by ion counting statistics. Therefore, a goal is to detect every ion that the source emits. The benefits of detecting every ion from the source are the highest possible sensitivity, dynamic range, quantitative accuracy, and analytic throughput: these performance metrics are limited only by the brightness of the ion source.

To understand the significance of this development, consider the relatively low fraction of ions currently detected in commercial mass spectrometers. Quadrupole mass spectrometers scan a narrow mass filter (e.g., 0.7 Da wide) over the mass spectrum. Out of a mass range of 700 Da, at any given instant, ions from only 0.1% of the mass spectrum are reaching the detector and being analyzed; ions from the remaining 99.9% of the mass spectrum are crashing into the quadrupole rods. In a TOF, any given pulse of ions contains the entire mass spectrum. However, because the ions arrive in pulses at the detector, the capacity of the detector is frequently challenged. In current TOFs, the ion beam is intentionally attenuated by 10-100× fold during MS-I analysis to prevent saturation of the detector. Ion-trapping mass spectrometers are also unable to make good use of the source brightness. For example, because the Orbitrap analyzer, for example, has a capacity of only about one million ions, the analyzer is typically filled in hundreds of microseconds while the analysis times are measured in tens to hundreds of milliseconds. Ion traps have faster analysis times, but also smaller capacity. In either case, it is typical for only 0.1% to 1% of the ions to be detected in MS-1.

Detector capacity in currently available commercial mass spectrometers is better matched to MS-2 analysis because some degree of ion isolation is required to allow interpretation of the resulting spectrum. By selecting only a fraction of the mass spectrum at any time, the ion intensity sufficiently reduced so that the detector is not saturated. In this case, or in any case where the full intensity of the ion source can be detected, sensitivity is limited by the duty cycle of the analyzer, the fraction of ions that are recorded by the detector. TOF analyzers in current use lose ions that arrive at the accelerator in between pulses. These losses are most severe for low-mass ions, which may travel from one end of the pulser to the exit before an ion pulse is applied. Even for high-mass ions, losses of 70% or greater are typical. Techniques for buffering the ions at the pulser to prevent losses have been developed. These techniques, however, add cost and complexity to the instrument and may introduce other problems.

A key benefit of the MegaTOF concept is the use of a detector array with hundreds of thousands to millions of detector elements to improve dynamic range and sensitivity, especially in MS-1 spectra. Although the capacity of each element is relatively small—up to a few million ions per second, the detector array, viewed collectively, is capable of recording ions from the entire mass spectrum produced by the most intense ion sources. Each discrete TDC detector element is capable of performing measuring the time-of-flight of a single ion in a given sweep. Therefore, the ion beam is swept across the detector elements so rapidly that, on average, the ion flux is far less than one ion per detector element per sweep. If two or more ions are deflected onto the same element in a given sweep, the times of flight of some ions may not be correctly measured, resulting in losses. Therefore, the sweep rate is high enough so that such events occur at a very low frequency.

By spreading the ion flux over hundreds of thousands of independent detector elements working in parallel, the detection system could have the capacity to consume the brightest beams that ion sources are capable of delivering—up to one billion ions per second. A proposed embodiment of the detector (a 2×2 array of TimePix3 detector chips) is capable of recording 320 million ions per second. The limit is communication bandwidth. It is reasonable to expect that communication bandwidth will follow Moore's law, so that detector capacity will soon surpass beam brightness. In this case, the sensitivity of the MegaTOF analyzer is limited only by the rate at which analyte ions can be generated from a sample and delivered to the analyzer.

The demands for high spatial resolution and high temporal resolution imposed by massively parallel TOF MS can be met by a TimePix3 detector, for example. The TimePix3 array detector is one of a family of array detectors for charged particle detection by a consortium of high-energy physics laboratories including CERN. The TimePix3 detector is a CMOS (complementary metal-oxide semiconductor) chip with 256×256 detector elements. Each element is a square time-to-digital converter (TDC) 55 us across, capable of measuring the arrival time of a particle. The TimePix3 detector delivers two key advances over its predecessor TimePix that are critical to the practice of the invented method: 1) improved time measurement precision and 2) data-driven readout.

In TimePix3, a fast 640 MHz oscillator is triggered immediately upon event detection. An event can be measured with a granularity of the oscillator period, 1 s/640M=1.5625 ns=1562.5 ps. That is, all events occurring within a time interval of 1562.5 ps are assigned the same quantized time value. The maximum time error of the quantized value is half the oscillator period, i.e., +/−781.25 ps. The root-mean-square deviation (RMSD) time error due to quantization is 1562.5 ps/$(12)^{1/2}$=451.05 ps. TimePix3 offers significant improvement over the original TimePix detector, which used a 100 MHz clock and was capable of measuring arrival times with a granularity of 10 ns. For TOF MS, 1.56 ns time granularity is only marginally acceptable, but given the rapid pace of improvements in semiconductor-based solutions, further improvements are expected in the near future.

The impact of the clock period on mass accuracy and mass resolving power is discussed in detail below. In TOF MS, the mass resolving power is half the "time resolving power". For example, if the uncertainty in time is 1 part in 20 k, the mass resolving power is 10 k. Ion times of flight are typically in the range of tens of microseconds, and commercial TOF MS instruments are capable of mass resolving power around 30 k. Therefore, the precision of time measurements for a commercially viable TOF MS is about 1 ns.

TimePix3 also has the capability to read out individual events as they are detected, rather than reading out an entire frame of detected events at regular intervals. The maximum hit rate of a TimePix3 chip is 80 M events/chip/s. A typical configuration of four TimePix3 chips in a 2×2 array would be capable of recording 320 M events/s. This capacity is nearly matched to the most intense beams that can be generated by an ion source, up to 1 B ions/s. Each chip has a communication bandwidth of 5.12 Gb/s. Here, too, further improvements are expected in the near future, so that the chips are capable of recording the brightest ion sources that can be produced.

Each pixel has a dead time of 375 ns. The same pixel can be read at a repeat rate of 2.67 M events/s, assuming that the total communication bandwidth of 80M events/s shared by all detector elements on the chip is not exceeded. Spreading events over the entire detector array by rapidly sweeping the beam reduces the chances of ions striking dead detector elements so that dead-time artifacts will be minimal, and in many cases, negligible. Potential intensity distortions arising from detector dead time and a method for correcting them are discussed in detail below. Detector dead time correction has been used in a commercial triple quadrupole mass spectrometer to extend dynamic range by a factor of 10.

Because of the way that ions are swept across the detector, an intense ion may leave a shadow behind it as ions of slighter higher mass (and thus slightly longer times of flight) trail behind it and encounter dead detectors. Ions whose times of flight differ by more than the detector dead time do not interfere with each other. The required correction for a given mass can be calculated from the intensities of ions in the mass interval from just below that mass up to and including that mass in the mass spectrum.

A Rotating Magnetic Field Beam Deflector

In various embodiments, a deflector that sweeps ions over the detector array is a device that generates a rapidly rotating magnetic field. An exemplary deflector, developed at Brookhaven National Laboratory (BNL), used a magnetic field rotating at 700 kHz to combine multiple beams of 200 keV electrons. The device consists of coils of wire in a solenoid shape wrapped around a Zn—Mn ferrite, whose low coercivity allows the magnetic field to be rotated without large power losses. The rotating field is produced by sending two phases of sinusoidal current into the wires so that the x- and y-components of the field varying sinusoidally. The vector sum of the components has a constant magnitude and rotates with the same frequency as the input current.

The device has a 20 cm axial extent and a 10 cm internal diameter. The field strength is 600 Gauss (0.06 Tesla) at its central cross section and with an effective field strength of 400 Gauss on average along its 20 cm length. The device was originally designed to deflect a 200 keV electron by thirty degrees, as required in the BNL combiner. The field was highly homogeneous over a region with a circular cross section of 3 cm in radius.

In various embodiments, a highly focused beam is sent into the detector so that a large region of homogeneity is not required. The device may be shrunk radially without loss of performance. This allows a stronger magnetic field to be generated at the center of the device without an increase in the applied current and power. As a result, the axial dimension of the device can be reduced to reduce the flight time of ions through the device and reduce time-of-flight distortions.

The same field strength used in the electron combiner application is sufficient to deflect singly-charged 10 keV ions a few millimeters over a path length of a meter for masses of interest in typical mass spectrometry applications (i.e., 100-1000 Da).

Power utilization of the described device was about 600 W and, in the electron combiner, air cooling was sufficient to dissipate this energy. As part of a TOF MS instrument, deflected ions need to be analyzed at very low pressures. To keep the device cool, it is placed outside of the low-pressure "vacuum" chamber where the ions are analyzed. Therefore, the ions are sent through an enclosed chamber that lies fully within the orifice of the solenoid. The chamber is constructed of a material such as quartz that is both transparent to the magnetic field and has a low coefficient of thermal expansion.

TOF Mass Analysis by Rotating Magnetic Field

Suppose a mono-energetic beam of spatially focused ions is directed upon a deflector, comprising a rotating magnetic field. The magnetic field induces a larger deflection on lighter ions than smaller ions. More precisely, the tangent of the deflection angle is proportional to $(m/z)^{-1/2}$, as described below. This is referred to as radial deflection. The magnetic field induces m/z-dependent radial separation of ions.

Ions with the same axial energy have different axial velocities, also proportional to $(m/z)^{-1/2}$. Therefore, ions travel from the deflector to a detector with times of flight that are proportional to $(m/z)^{1/2}$. Ions with different m/z values that arrive at the deflector at the same time are separated in time on the detector.

Ions with different m/z values that arrive at the detector at the same time have different times of flight and thus passed through the deflector at different times. Because the magnetic field is rotating, ions with different m/z values that arrive at the detector at the same time are separated angularly on the detector.

The separation of ions in time, radial displacement, and angular displacement can be used for mass analysis. In particular, one can calculate the m/z value of any ion striking the detector from its time of arrival, its radial displacement from the origin of the detector, and its angular displacement with respect to a fixed axis.

To understand how any ion's time-of-flight can be calculated from its position of arrival and time of arrival, one can think of the rotating magnetic field vector as the hand of a clock. The hand of the clock moves angularly from its initial position (when an ion passes through the deflection field) to its final position when the ion strikes the detector.

The initial position of the deflection field (the hand of the clock) is inferred from the angular position where the ion strikes the detector. The final position of the deflection field is calculated from the time of arrival—using the known frequency of the rotation and the known position of the deflector field at "time zero".

If the difference between the longest time-of-flight and the shortest time-of-flight for the chosen mass range is less than the rotation period of the deflection field, the angular displacement gives an unambiguous measurement of the time-of-flight. However, such an arrangement does not provide an effective use of the available area for detector. The entire mass spectrum is wrapped onto a segment no longer than the circumference of a circle whose radius is defined by the radial deflection of the lightest mass.

If, instead, the difference in ion times of flight is many times greater than the rotational period of the deflection field, the angular position of the ion (alone) does not disambiguate various possible times of flight. For example, all ions whose times of flight differ by an integer multiple of the rotation period would have the same angular displacement.

Without loss of generality, suppose that the hand of the clock points to 12 o'clock when the clock is started, i.e., at time zero. Suppose that the magnetic field is rotating at 1 MHz, which means that the field completes a full rotation in 1 us. Now suppose that an ion passes through the detector when the hand of the clock is at 12 o'clock and that the ion strikes the detector exactly 20 us later. The ion is observed at the 12 o'clock position on the detector at some time T. In this case, T (in units of microseconds or equivalently in units of the rotation period) is an integer because the clock started at 12 o'clock at time zero and passes through the 12 o'clock position at each integer value of T, just as it did when the hypothetical ion passed through the deflector, and twenty times more as the ion flew towards the detector, reaching its twentieth rotation just as the ion struck the detector.

In this example, the actual time that the ion passed through the deflector was T-20 microseconds. This fact was discovered from the position where the ion struck the detector, and thus the ion's time-of-flight. All that is needed to know is the position of the hand of the clock at time zero. If this directly cannot be controlled, i.e. by synchronizing the clock used for measuring ions with the clock that controls the magnetic field, the position of the field can be calibrated at time zero of the ion clock by measuring an ion of known mass-to-charge ratio.

In this example, when an ion strikes at 12 o'clock, the time of departure is as an integer number of microseconds. Alternatively, if an ion strikes the detector at the 1 o'clock position, the time of departure is n+1/12 microseconds, where n is an integer. However, knowing that the time of departure is an integer is not enough for mass analysis—the time of departure may have been T-1, T-2, T-3, etc. corresponding to times of flight of 1, 2, 3, and any arbitrary integer number of microseconds, including the actual time-of-flight, namely 20 microseconds.

These various possible times of flight can be distinguished from the radial displacement of the ion's position on the detector. As mentioned above, the radial displacement depends upon $(m/z)^{-1/2}$, while the time-of-flight depends upon $(m/z)^{1/2}$. Therefore, the time-of-flight is inversely proportional to the radial displacement. The constant in this relationship can be calculated from the flight length, the strength of the magnetic field, and the acceleration potential, or it can also be calibrated by measuring an ion of known mass-to-charge ratio.

The radial information is used to make an independent measurement of the time-of-flight. The accuracy of this measurement need only be of sufficient accuracy to be able to distinguish 20 from 19 or 21. In this case, the resolving power of this measurement is approximately 20. Even though this sounds like a relatively simple task, in fact, the radial displacements get progressively closer together as 1−½>½−⅓−¼> etc.

Geometrically, adjacent integer numbers of rotation periods of the hand of the clock correspond to adjacent rings of the spiral pattern traced out on the detector. These rings get increasingly close together as the spiral tracks inward. Eventually, the rings of the spiral are closer together than the diameter of the beam so that an ion strike cannot be confidently assigned to the correct ring. This point corresponds to the upper limit of the mass range.

Figure 2:
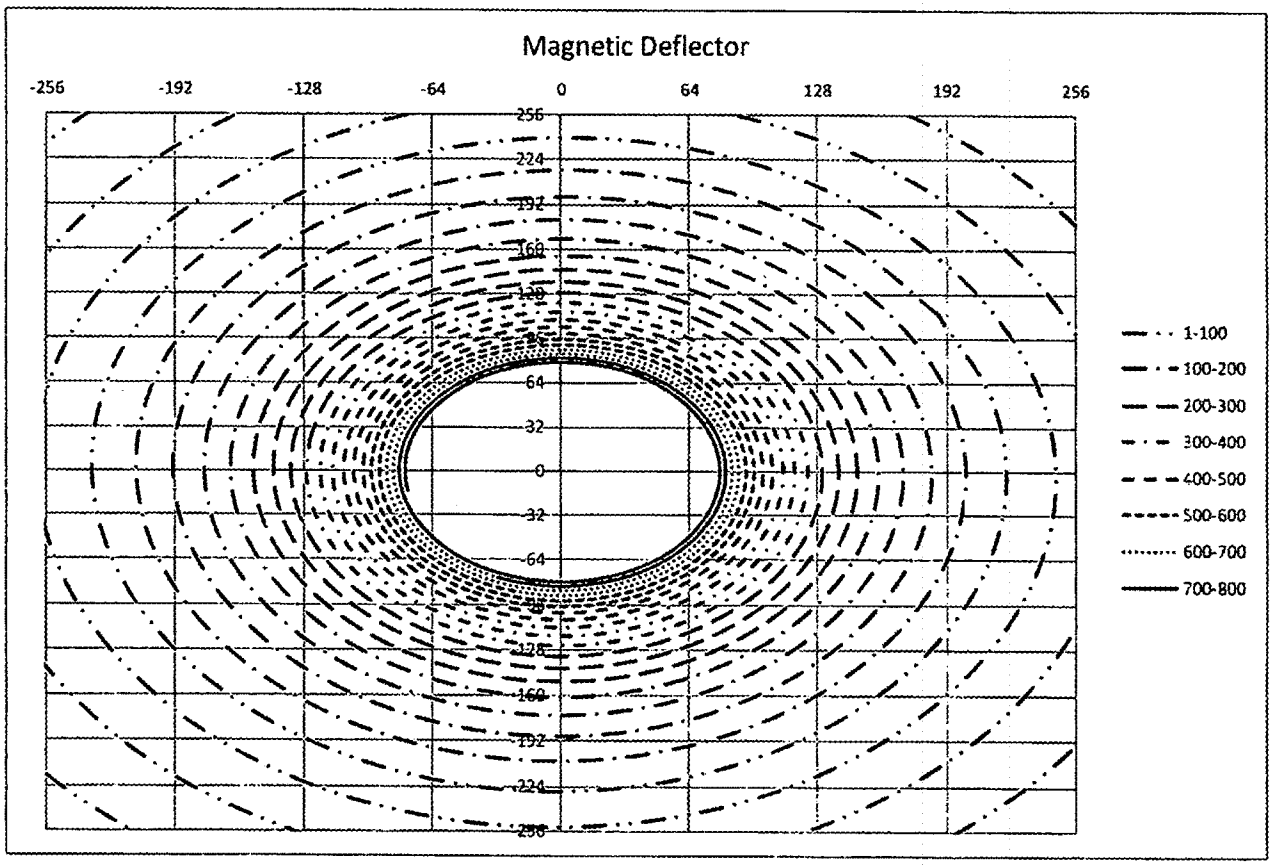
FIG. 2 is an exemplary plot showing the m/z-dependent mapping of accelerated ions onto an area detector when the rotation frequency of the magnetic field is 700 kHz, in accordance with various embodiments.

FIG. 2 is an exemplary plot 200 showing the m/z-dependent mapping of accelerated ions onto an area detector when the rotation frequency of the magnetic field is 700 kHz, in accordance with various embodiments. The high-mass limit can be changed by varying the operating parameters of the instrument—for example, by reducing the rotating frequency by a factor of two.

Figure 3:
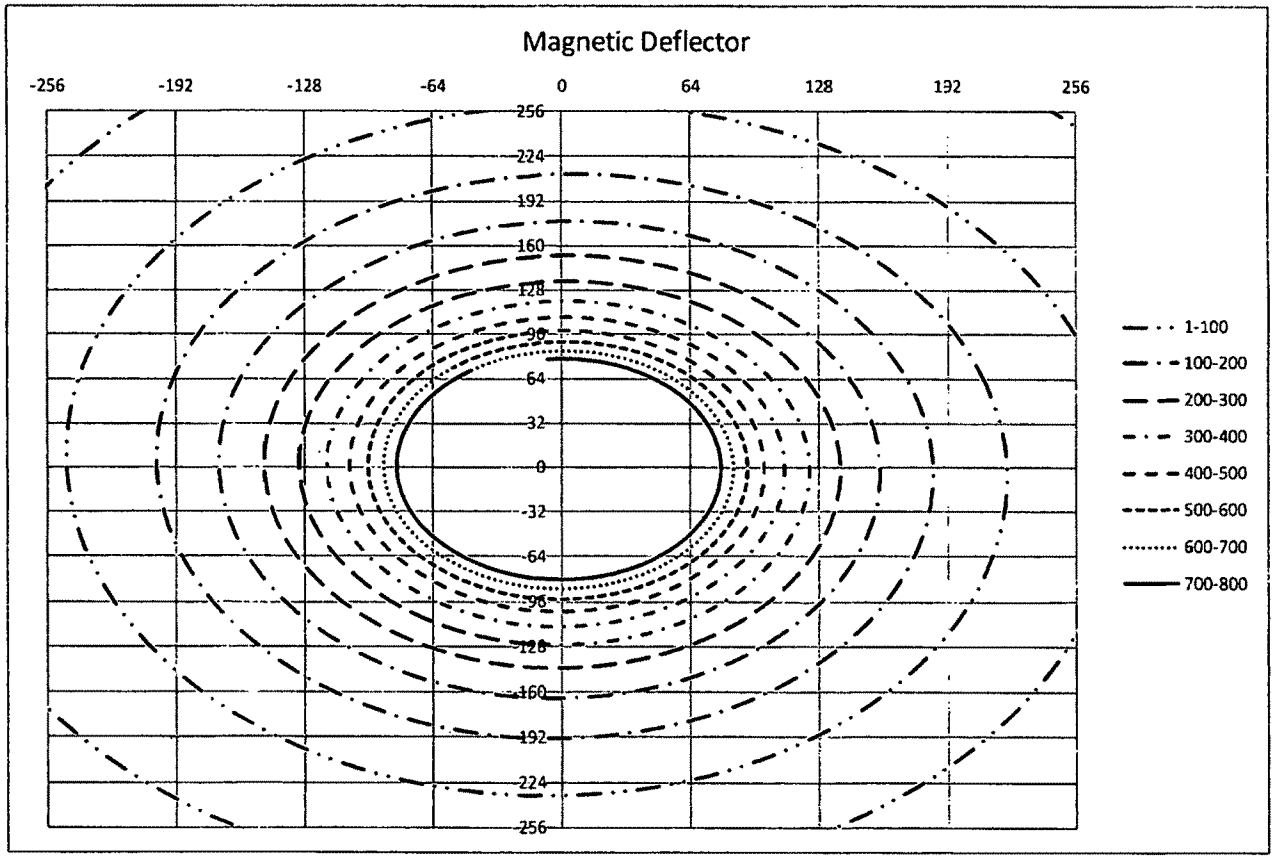
FIG. 3 is an exemplary plot showing the m/z-dependent mapping of accelerated ions onto an area detector when the rotation frequency of the magnetic field is 350 kHz, in accordance with various embodiments.

FIG. 3 is an exemplary plot 300 showing the m/z-dependent mapping of accelerated ions onto an area detector when the rotation frequency of the magnetic field is 350 kHz, in accordance with various embodiments. The increased mass range achieved by reducing the rotating frequency comes at the cost of reduced mass resolving power.

Alternatively, the high-mass limit can be extended by operating at a point where adjacent rings are separated by less than the beam diameter. To assign ions to the correct ring, the rings are slid past each other dynamically by modulating an operating parameter, e.g., rotation frequency, that slightly unwinds the spiral. As the rings of the spiral move past each other, the ions are carried in one direction or the other, identifying the correct ring, and thus the correct time-of-flight.

The low-mass limit is determined by the point where the ions are deflected to the edge of the detector. The edge of a square detector is closest to the center at the coordinate axes and furthest at the corners. Ions that lie between these two limits are detected with reduced efficiency that is determined by the fraction of the circle that lies within a square. The intensities of ions in this range are determined by applying a geometric correction factor to the observed number of ions.

To summarize, it is convenient to express the time-of-flight in units of the rotational period of the deflection field. The radial displacement provides the integer part of the time-of-flight, and the angular displacement gives the fractional part of the time-of-flight. The measured arrival time provides the current direction of the field, and that the angular displacement of the ion is measured relative to the current field direction. Using the radial and angular displacement together to analyze ions fills the detection area with the mass Spectrum. Another way to view this same property is that a wide range of time-of-flight values can be measured with reasonably high precision.

Circulant Rastering by an Electric Field

In various embodiments, the deflector is a time-dependent electric field that sweeps the ion beam across the detector array in a circulant raster pattern. A raster pattern consists of continuous back-and-forth motion of the beam along one axis of the detector array while the beam is stepped in the orthogonal direction by one beam diameter each time a new row is completed. A circulant raster refers to connecting two ends of the raster to form a closed loop.

All ions that pass through the deflector at the same time are deflected in the same direction by a rotating electric field. Unlike in a magnetic field, all ions, regardless of m/z, undergo the same magnitude of deflection when instantaneously deflected by a rotating electric field. It is assumed that the ion's transit time in the deflector has little effect upon its position on the detector. This is strictly true in each row of the raster because the field is changing linearly in time. At the turnaround points, the assumption is good when the deflector has a limited spatial extent to minimize ion transit times.

However, as noted in the previous section, ions with different m/z values that arrive at the detector at the same time strike the detector at different locations because they passed through the deflector at different times as a consequence of their different times of flight. Ions with different m/z values that arrive coincidentally arrive at different positions on the detector because the deflection field was routing ions to different positions at the times when the ions passed through. Although the ions arrive coincidentally, they strike different independent detector elements, and thus are recorded in parallel. This contrasts with the case of a single-channel detector system in which coincident events cannot be recorded.

As with other embodiments, at a given instant in time, the entire mass spectrum is mapped onto the detector. Ions whose mass-to-charge ratio goes to zero have infinitesimal flight times; the arrival position of such ions on the detector indicates the current direction of the deflection field. An ion with a non-negligible mass-to-charge ratio has a non-negligible flight time, i.e. a flight time of T; its arrival position indicates the direction of the deflection field T time units earlier. Successively heavier ions have successively longer flight times and thus indicate directions of the deflection field at successively earlier times. The position of ions in the continuous mass spectrum arriving at the detector in a given instant reflects the history of the deflection field over time.

Time-of-Flight Analysis by Circulant Raster Scanning

In various embodiments, the (transaxial) electric field is scanned so as to sweep the focused beam across a detector array. Let $p_0$ denote the point on the detector to which ions are currently being deflected. Ions of mass zero would arrive instantaneously at this position. Ions with mass require some flight time to travel from the deflector to the detector. Let $p_M$ denote the point on the detector where an ion strikes the detector at the same instant as the ion of mass zero. If the time-of-flight of an ion of mass-to-charge M is $T_M$, then its arrival position $p_M$ indicates the direction of the electric field at time $T_M$ earlier.

If the beam sweeps across the detector with a constant speed, then the time-of-flight of an ion striking the detector at position $p_M$ is equal to the length of the beam path between $p_M$ and $p_0$ divided by the sweep rate. Given the time-of-flight, the mass-to-charge ratio of the ion can be calculated as in conventional TOF MS.

Figure 4:
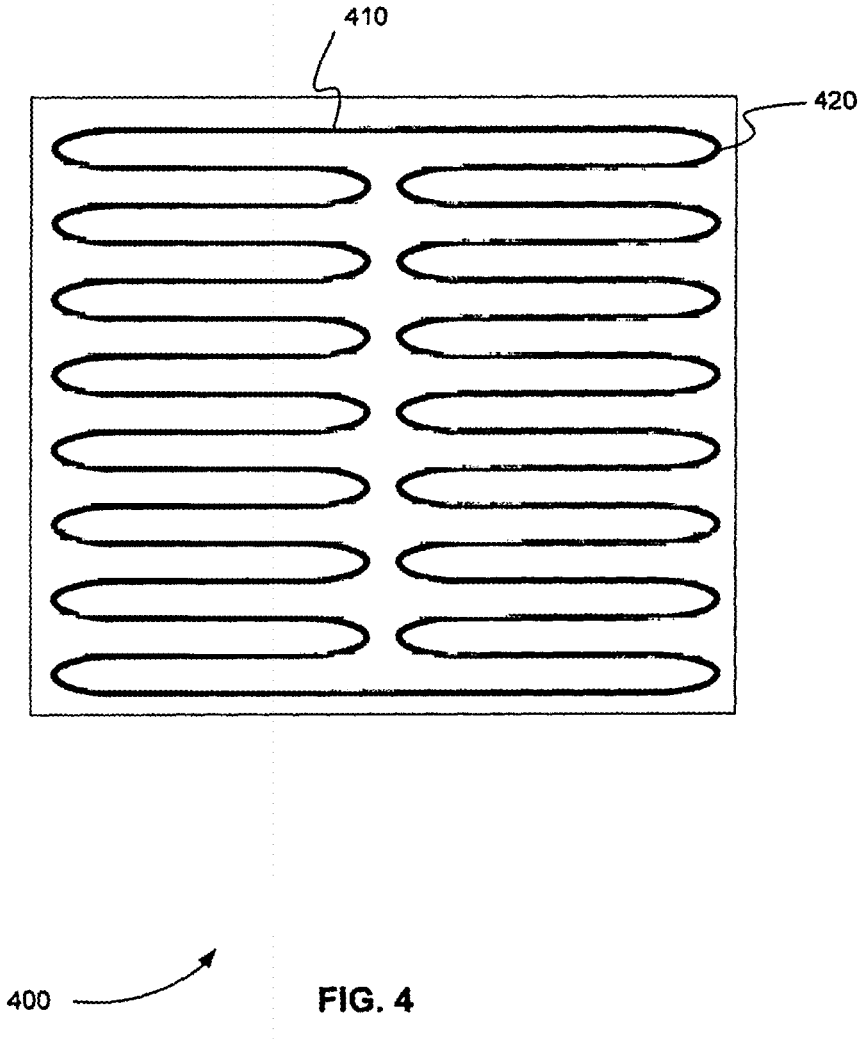
FIG. 4 shows an exemplary detector with a two-column raster pattern that is formed by sweeping an ion beam across the detector using a periodic electric field, in accordance with various embodiments.

FIG. 4 shows an exemplary detector 400 with a two-column raster pattern 410 that is formed by sweeping an ion beam across detector 400 using a periodic electric field, in accordance with various embodiments. To make a continuous raster, adjacent rows are scanned in opposite directions and connected by a smooth curve 420 such as a semi-circular arc. To make a closed loop, the area of the detector is divided in two halves, scanning successive rows upward in one half and then downward in the other half, connecting the two rasters with long rows that extend across the entire width of the chip at the top and bottom of the chip.

Figure 5:
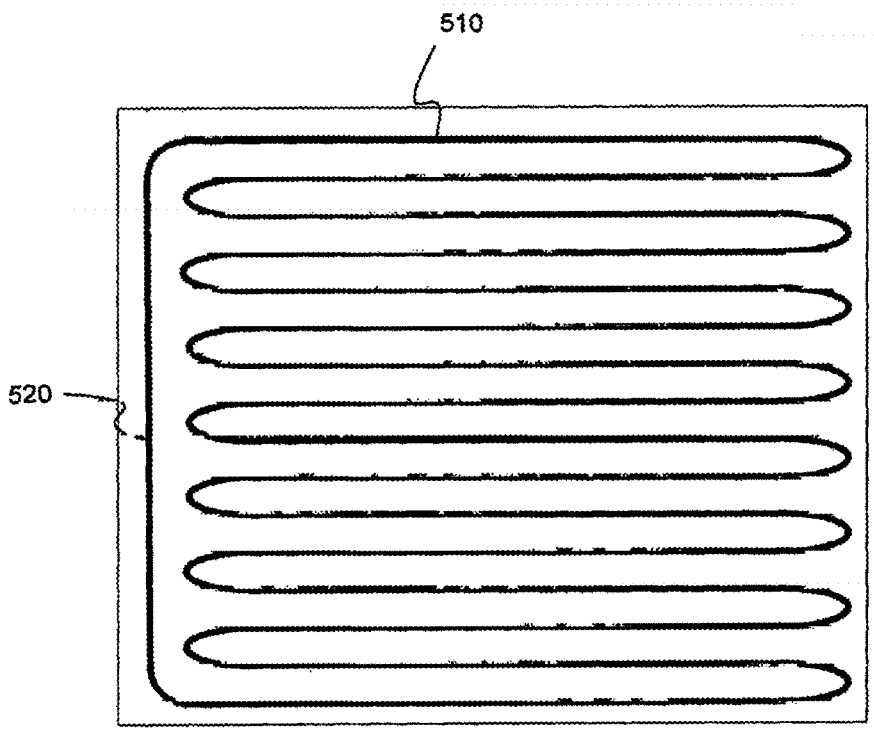
FIG. 5 shows an exemplary detector with a one-column raster pattern that is formed by sweeping an ion beam across the detector using a periodic electric field, in accordance with various embodiments.

FIG. 5 shows an exemplary detector 500 with a one-column raster pattern 510 that is formed by sweeping an ion beam across detector 500 using a periodic electric field, in accordance with various embodiments. A continuous loop is constructed by a simple raster that covers nearly the entire width of the detector area, but with an even number of rows so that the last row is connected to the first row with vertical line 520 running along the edge of the detector 500. The horizontal rows must leave enough space along the edge of detector 500 so that the vertical line 520 intersects only the first row of the raster where the loop is closed Many of the performance issues regarding the operation of the electric field rastering instrument are similar to the rotating magnetic field instrument.

The raster path traveled in each time period must be very long in order to make precise time-of-flight measurements over a wide range of time-of-flight values. The scan period of the raster times the sweep rate defines the length of the raster. It is most convenient to express the sweep rate and the raster length in units of pixels, i.e., detector elements.

The sweeping of the beam across detector elements can be thought of as chopping the beam into time slices. The ions at the deflector that are destined for a particular detector element represent a very small time slice of the beam, on average less than one ion. Ions of various ink values in the time slice spread out axially because of their various axial velocities. These ions that passed through the deflector at the same time, arrive at the detector at various times that reflect the range of time of flight values.

To make unambiguous measurements of the time-of-flight of each ion, ions that arrive at the same pixel that originated from successive sweeps of the beam should not overlap. It is not necessary for the next sweep to wait for the heaviest ions from the previous sweep to reach the detector, but it is necessary to wait long enough so that the lightest ions cannot catch up. In particular, the period of the raster pattern can be no longer than, and is preferably matched, to the range of ion flight times of the desired mass range.

Ions outside the desired mass range should be blocked (i.e., by a quadrupole mass filter) from reaching the detector so they are not mistaken for ions within the desired mass range. For example, a lighter ion with time of flight $T-T_r$ could be misinterpreted as an ion of time of flight T, where $T_r$ is the period of the repeating raster pattern. Both ions would arrive at the same position, but the lighter ion left the deflector one raster period later. Similarly, a heavier ion with time of flight $T+T_r$ that left the deflector one raster period earlier could be misinterpreted as an ion of time of flight T. Mass filtering is necessary to prevent these errors.

Preferably, a full scan of the beam around the detector corresponds to a time interval as long as the different in the time-of-flight between the lightest and heaviest ions. Alternatively, a scheme of scanning can be used at different rates to assign ions from overlapping time slices to their correct time slice.

The mass spectrum is spread out across the entire area of the detector following the serpentine path of the beam with heavier ions trailing behind lighter ions. The entire mass spectrum is pulled along this path at the same rate as the beam.

The length of the raster times the beam diameter defines the required detector area necessary for analysis. Consider a simple case where the desired time-of-flight range is 20 us and the sweep rate is 1 pixel/ns. Then the length of the raster is 20 k pixels. If the beam diameter is one pixel, then the required detection area is 20 k pixels.

Now suppose that the beam diameter is four pixels rather than just one. To achieve the same precision in the time-of-flight measurement, the sweep rate needs to increase to 4 pixels/ns. The length of the raster would increase to 80 k pixels. And now, the width of the raster would also increase, so the required detection area would be 320 k pixels. The required detection area roughly matches the number of detectors (262 k) provided by a 2×2 array of TimePix3 chips.

Because the required sweep rate increases with the beam diameter and the required detection area increases with the square of the beam diameter, ion beam focusing is critically important in building an analyzer with suitable performance metrics using the concepts of the disclosed method. The required sweep rate to achieve a given precision in the time of departure also increases with the beam diameter.

The rastering of the beam across a detector is reminiscent of the mode of operation of the first televisions. As in the television, the use of an Einzel lens to focus the beam may be an important feature in enhancing the performance of the device.

One advantage of the electric field rastering method over the rotating magnetic field method is that the raster can spread ions uniformly and tightly to make optimal use of the detector area. In contrast, the magnetic field produces a hyperbolic spiral, in which the outer rings are further apart than the inner rings.

The better use of the detector area in the rastering method comes at the price of additional complexity in programming the electric field profile to sweep a continuous raster pattern at constant speed over the detector area. In contrast, the rotating magnetic field involves only continuous circular motion of the field, achieved by two phases of a sinusoidal input signal.

General Features of Mass Analysis in TOF MS

The MegaTOF analyzer is essentially a time-of-flight mass spectrometer (TOF MS). As with any TOF MS, the mass-to-charge ratio (m/z) of each ion is calculated by measuring the time-of-flight across a known distance of an ion accelerated across a known potential difference V, ideally from rest. There are two expressions for the ion's kinetic energy after it has been accelerated:

$$K = zV \tag{1}$$

$$K = \frac{1}{2}mv^2 = \frac{1}{2}m\left(\frac{L}{T}\right)^2 \tag{2}$$

The first depends upon the ion's charge z and the known potential difference V; the other that depends upon the ion's mass m, its known distance of flight L, and its measured time-of-flight T. The two expressions are set equal to each other, and the unknown mass m and unknown charge z can be combined as a ratio (m/z), brought to one side of the equation, and expressed in terms of known quantities and the measured time-of-flight.

$$\frac{m}{z} = 2V\left(\frac{T}{L}\right)^2 \tag{3}$$

In any TOF MS, each ion's time-of-flight T is the difference between the time $T_a$ that the ion arrives at a detector and the time $T_d$ that the ion departs from a starting point at a known distance from the detector.

$$T=T_a-T_d \tag{4}$$

Impact of Clock Period on Mass Accuracy and Mass Resolving Power

Precise time measurement is critical for mass accuracy and mass resolving power in TOF MS. Suppose there are ions with two distinct m/z values, and thus a time-of-flight difference Δt. Then, the spread in the measured time-of-flight needs to be less than Δt in order to interpret the collection of time-of-flight measurements as arising from two distinct ion species.

As an example, suppose a mass resolving power of 10 k is required for an ion whose time-of-flight is 20 us. Differentiating both sides of Equation 3 leads to an expression for resolving power in terms of precision in the time-of-flight measurement.

$$\frac{m}{\Delta m}=\frac{1}{2}\frac{T}{\Delta T} \tag{5}$$

Solving for ΔT, shows that the uncertainty in T required for 10 k mass resolving power with flight times of 20 us must be less than 1 ns.

As seen in Equation 3, the time-of-flight can be increased by increasing the path length or decreasing the ion energy. Both of these solutions can cause difficulties. Increasing the path length either requires a larger instrument or a multi-turn path. Multi-turn paths introduce ion losses, reduce focusing, and add cost and complexity. Decreased ion energy can reduce mass resolving power by decreasing the ratio K/ΔK, i.e., the mean axial kinetic energy of ions to the spread in energy among ions. The axial kinetic energy spread is typically independent of K, so typically TOF mass analyzers use the largest practicable value for K.

The variance in the time-of-flight measurement is the sum of the variances of the time of arrival of the time of departure measurements.

$$\sigma_T^2=\sigma_{T_a}^2+\sigma_{T_d}^2 \tag{6}$$

In conventional TOF, the uncertainty in the departure time $T_d$ arises from small variations in measuring the rise time of a pulse. In various embodiments of the invention, the uncertainty in the departure time depends upon how fast a beam can be swept across a detector element. In both instruments, the uncertainty in the arrival time $T_a$ depends upon the clock period.

Suppose that only the finite clock frequency of the TimePix3 detector elements (640 MHz) places a limit on mass resolving power. Then, a true ion time-of-flight of T results in measurements uniformly distributed in the range T−ΔT/2 to T+ΔT/2. The resulting m/z estimates resulting from the time-of-flight measurement of an ion with mass-to-charge ratio m is distributed in the range m−Δm, m+Δm, where $\Delta m=m^{1/2}\,\Delta T$.

In this case, the mass resolving power is inversely proportional to ΔT and increases as $m^{1/2}$.

If only one ion species is present and there are N statistically independent measurements of the ion's time-of-flight, then the best estimate of the ion's m/z is derived from the mean time-of-flight. For small errors, this is essentially equivalent to the mean of the estimated values of m/z formed from the individual time-of-flight measurements. The variance of the sample mean decreases as 1/N. Thus, in the absence of systematic errors, mass accuracy in TOF MS is a statistical property, in that it depends upon the number of measurements.

In the case where there are many independent factors that contribute to errors in the estimate of an ion's m/z value, the variance resulting from the finite clock frequency best reflects the contribution of finite clock frequency to the total mass accuracy or mass resolving power. An ion recorded in a given detector element has an arrival time that is uniformly distributed between −ΔT/2 and ΔT/2, resulting in a variance of $\Delta T^2/12$.

$$\sigma_{T_d}^2=\int_{-\Delta T/2}^{\Delta T/2} t^2\,dt=\frac{\Delta T^2}{12} \tag{7}$$

Angular Displacement of a Rotating Magnetic Field

Because a given ion species has a fixed time-of-flight in an experiment, the total angular displacement of the deflector field during the ion's time-of-flight is constant. Therefore, the position that a given ion species strikes the detector rotates synchronously with the deflector field over time. In other words, the angular displacement of a given ion species is constant with respect to the rotating magnetic field direction.

The total angular displacement θ of the rotating field can be thought of as a clock that measures an ion's time-of-flight.

$$\theta=2\pi\frac{T}{T_r} \tag{8}$$

The field sweeps out 2π radians for each period of rotation $T_r$ during the ion's time-of-flight T.

Given a limit in the precision of how accurately the angularly displacement can be measured, the precision of the time measurement increases with the frequency of rotation of the field.

However, the total angular displacement of the field is not directly observable. Instead, only the angular displacement of the field modulus 2π is observer. That is, the angle is measured from the direction of the deflection field to the vector formed by the ray from the center of the detector to the ion's deflected position. This is equivalent to measuring the $$\theta_{obs}=\theta\%2\pi \tag{9}$$

To make an estimate of the time-of-flight from the observed angular position, the number of complete rotations of the field during the ion's time-of-flight need to be determined.

$$\hat{T}=\left(n+\frac{\theta_{obs}}{2\pi}\right)T_r \tag{10}$$

For simplicity, consider a magnetic field rotation frequency of 1 MHz. Consider an ion that strikes the detector in the shadow of the deflection field. That is, the magnetic field completes an integer number of rotations in the time interval that the ion flies from the deflector to the detector. In this case, the ion's time-of-flight is an integer number of microseconds. That is, the ion's time-of-flight may be 1 us, 2 us, 3 us, . . . .

Similarly, if the ion strike is rotated 180 degrees from the shadow of the deflection field, the ion's time-of-flight may be 0.5 us, 1.5 us, 2.5 us, 3.5 us . . . .

Radial Deflection of an Ion by a Magnetic Field

The radial deflection of an ion by a magnetic field can be calculated in terms of the change in momentum imparted by the magnetic field. The magnetic force is perpendicular to the beam direction and is the product of the ion's charge z, the ion's axial velocity v, and the magnetic field strength B.

$$F=zvB \tag{11}$$

The change in the ion's momentum is the product of the applied force F and the duration of the applied force Δt. In general, the force varies with time, and so the equation can be expressed as an integral of force over time. However, the equations can be simplified by considering F to be the time-averaged force over the interval Δt and considering B to be the time-averaged magnetic field. The change in momentum is also equal to the product of the ion's mass and its perpendicular velocity after application of the force.

$$\Delta P = m\Delta v = F\Delta t = (zvB)\frac{d}{v} = zBd \tag{12}$$

d represents the effective axial length of the magnetic field. For consistency, Δt is set equal to d/v. The specific values of d and Δt used to compute the time-averaged field are arbitrary, as long as they are chosen consistently. As shown in Equation 16, the product Bd is the change in momentum per unit charge induced by the magnetic field. This quantity is independent of ion mass or velocity. The change in momentum induced by the magnetic field can be calibrated by observing the deflection of a known calibrant ion.

To simplify this analysis, the fact that Δt varies slightly for ions with various m/z is neglected. The angular deflection of the ion onto the detector is independent of Δt as long as the time of flight is measured from the axial midpoint of the detector. The radius of the ion's position on the detector is slightly diminished as ΔT increases by a factor that depends on the average of cos 2pft over the interval [−ΔT/2, ΔT/2]. As ΔT depends on $(m/z)^{1/2}$, the effect of flight time on radius of deflection is slightly larger for higher masses.

For example, if the flight length is 2 m, the deflector length is 20 cm, times of flight range from 10 us to 40 us, and the rotation period is 1 us, then the flight times through the deflector would vary from 0.1 to 0.4 rotation periods, the radius would be reduced by an additional factor ranging from 0.98 to 0.76.

Additional radial separation of ions is somewhat beneficial, and operating parameters can be adjusted to take advantage of this effect if desired. Here, it is assumed that operating parameters have been chosen to minimize this effect, only to simplify the analysis.

Solving for Δv in Equation 12 and re-labeling Δv, as $v_r$, denoting radial velocity:

$$v_r = \frac{Bd}{m/z} \tag{13}$$

The radial deflection R is simply the product of the radial velocity and time-of-flight.

$$R = v_r T = \left(\frac{Bd}{m/z}\right)\left(L\sqrt{\frac{m/z}{2V}}\right) = \frac{BdL}{\sqrt{2Vm/z}} \tag{14}$$

Now Equation 14 is written in terms of θ, by multiplying by the right hand side of Equation 14 by two bracketed terms, each equal to one. The first bracketed term is 1/T*T, where the expression for T comes from solving for T in Equation 3.

$$R = \frac{BdL}{\sqrt{2Vm/z}}\left[\frac{1}{T}\cdot L\sqrt{\frac{m/z}{2V}}\right] = \frac{BdL^2}{2VT} \tag{15}$$

The second bracketed term is 1/θ*θ, where the expression for θ comes from Equation 8. Because the radial displacement is proportional to the inverse of the angular displacement, the equation of a hyperbolic spiral is:

$$R = \frac{BdL^2}{2VT}\left[\frac{1}{\theta}\cdot\frac{2\pi T}{T_r}\right] = \frac{\pi BdL^2}{VT_r}\cdot\frac{1}{\theta} = \frac{k}{\theta} \tag{16}$$

k denotes the geometric constant of the hyperbolic spiral.

$$k = \frac{\pi BdL^2}{VT_r} \tag{17}$$

Combining the Ion's Radial and Angular Displacement

Equation 10 above, repeated here for convenience, provides a formula for calculating possible values for an ion's time-of-flight from its angular position on the detector. $\theta_{obs}$ is measured opposite the field rotation with respect to the magnetic field direction at the instant the ion strikes the detector.

$$\hat{T} = \left(n + \frac{\theta_{obs}}{2\pi}\right)T_r \tag{10}$$

To determine the actual time-of-flight from among these possible values, the value of the integer value n that denotes the number of complete rotations of the field during the ion's time-of-flight is calculated.

An estimate for n is calculated by making a coarse estimate of T using the radial displacement and Equation 15, plugging this estimate into the left-hand side of Equation 10, and solving for n and taking the nearest integer (adding ½ and taking the floor).

$$n = \left[\frac{\hat{T}}{T_r} - \frac{\theta_{obs}}{2\pi}\right] = \left[\frac{BdL^2}{2VRT_r} - \frac{\theta_{obs}}{2\pi}\right] \tag{18}$$

In an equivalent, but somewhat less elegant formulation of the time of flight calculation, n can be chosen as the value of T in Equation 10 that is closest to a coarse estimate of the time-of-flight, call it 1, that arises from solving Equation 15 for T.

$$\hat{T}_R = \frac{BdL^2}{2VR} \tag{19}$$

The Effect of Operating Parameters Upon Mass Range

An attractive property of various embodiments is that both the radial and angular components of an ion's position on the detector combine to provide an accurate estimate of its time-of-flight. These estimates are accurate over a relatively large range of time-of-flight values.

Given only an angular measurement, accurate estimates of the time-of-flight can be made for only a very narrow range of masses. The precision of the time-of-flight estimate is proportionally increased by rotating the field faster, but in so doing, the range of distinct time-of-flight values that can be determined unambiguously decreases by the same proportion.

Deflection of ions by a rotating magnetic field gives rise to a spiral pattern on the detector that can be thought of as the image of some segment of the mass spectrum. The low-mass limit is determined by the intersection of the spiral with an edge of the detector. The high-mass limit is determined by the point on the spiral where the separation between adjacent rings is equal to the beam diameter; ions heavier than this limit could not be reliably assigned to the correct ring of the spiral, resulting in errors in the time-of-flight estimate and ultimately errors in mass analysis.

One aspect of instrument performance correlates with the arc length of the spiral that can be used for time-of-flight measurements. The available arc length can be used to measure a narrow mass range with high resolving power or a wider mass range with proportionately less accuracy. The operating parameters of the system can be tuned to choose an operating point that represents the most desirable tradeoff between resolving power and mass range.

The radial separation between a ring at an (absolute) angular displacement of angle θ and the next inward ring is given by $$\Delta R = \frac{k}{\theta} - \frac{k}{\theta + 2\pi} = \frac{2\pi k}{\theta(\theta + 2\pi)} \tag{20}$$

Setting ΔR to b, the beam diameter, and solving for θ gives the angular displacement in the spiral at which adjacent rings are no longer resolvable.

$$\theta_{max} = \sqrt{\pi^2 + \frac{2\pi k}{h}} - \pi \tag{21}$$

Equation 8 is used to convert $\theta_{max}$ into a maximum time-of-flight.

$$T_{max} = T_r \frac{\theta_{max}}{2\pi} \tag{22}$$

Equation 3 is used to convert $T_{max}$ into a maximum m/z, an upper "mass" limit.

$$\left(\frac{m}{z}\right)_{max} = 2V\left(\frac{T_{max}}{L}\right)^2 \tag{23}$$

Equations 21-23 do not provide a sense of how the operating parameters of the instrument control the upper limit of the mass range.

First, an assumption is made that the number of rings of the spiral is much larger than one. Otherwise, the detector is not being used efficiently. In this case, $\theta_{max} \gg \pi$ and so $k/b \gg \pi/2$. The expression for $\theta_{max}$ in Equation 21 is replaced with an approximation. The expression fork in Equation 17 is used to introduce the operating parameters explicitly.

$$\theta_{max} = \sqrt{\pi^2 + \frac{2\pi k}{b}} - \pi \cong \sqrt{\frac{2\pi k}{b}} = \sqrt{\frac{2\pi}{b}\left(\frac{\pi BdL^2}{VT_r}\right)} = \pi L\sqrt{\frac{2Bd}{bVT_r}} \tag{24}$$

Plugging in this approximate value for $\theta_{max}$ into the expression for $T_{max}$ in Equation 24, provides an approximation for the maximum time-of-flight.

$$T_{max} = \frac{T_r}{2\pi}\theta_{max} \cong \frac{T_r}{2\pi}\left(\pi L\sqrt{\frac{2Bd}{bVT_r}}\right) = T_r L\sqrt{\frac{Bd}{2bVT_r}} \tag{25}$$

Finally, this approximate value for $T_{max}$ is placed into the expression for m/z max in Equation 25.

$$\left(\frac{m}{z}\right)_{max} = 2V\left(\frac{T_{max}}{L}\right)^2 \cong \frac{2V}{L^2}\left(T_r L\sqrt{\frac{Bd}{2bVT_r}}\right)^2 = \frac{BdT_r}{b} \tag{26}$$

The resulting expression for the high-mass limit is surprisingly simple. The mass limit can be increased by increasing the momentum per unit charge imparted by the detector (Bd), increasing the rotation period (or equivalently decreasing the rotation frequency), or focusing the beam to decrease its diameter.

The low-mass limit is determined by radial deflections of ions beyond the edge of the chip. Suppose the array is square with a side length of $L_{det}$. Ions with radial displacements less than $L_{det}/2$ always strike the detector. To find the m/z value where this occurs, R is replaced in Equation 18 with $L_{det}/2$ and m/z is solved for, labeling it as $(m/z)_{min}$.

$$\left(\frac{m}{z}\right)_{min} = \frac{(Bd)^2}{2V}\left(\frac{L}{\frac{L_{det}}{2}}\right)^2 = \frac{2(Bd)^2}{V}\left(\frac{L}{L_{det}}\right)^2 \tag{27}$$

Extended Low-Mass Limit

Ions with radial deflections less than $L_{det}/2$ always strike the detector and ions with radial deflections greater than $L_{det}/\sqrt{2}$ always miss the detector. But, ions with radial displacements between these limits strike the detector when they pass through the deflector when the field is directing the beam towards the corners of the detector.

Substituting $L_{det}/\sqrt{2}$ for R in Equation 18, produces an extended low-mass limit:

$$\left(\frac{m}{z}\right)_{min}^{ext} = \frac{(Bd)^2}{2V}\left(\frac{L}{\frac{L_{det}}{\sqrt{2}}}\right)^2 = \frac{(Bd)^2}{V}\left(\frac{L}{L_{det}}\right)^2 \tag{28}$$

Because the low-mass limit depends upon the square of the detector "radius" including ions that sometimes strike the detector can reduce the low-mass limit by up to a factor of two. For ions in between these two alternative values for the low-mass limit, the actual ion intensity can be estimated from the observed ion intensity using a geometric correction factor.

Geometric Correction Factor for Ion Intensity Estimates

Consider one of the four points in the intersection of a circle of radius R with a square with side length L/2 with the square and circle centered at (0,0) and for values of R between L/2 and L/√2. One can form a right triangle with one vertex at the origin, one vertex at (L/2,0), and the last vertex at the intersection of the square and the circle, $$\left(\frac{L}{2}, \sqrt{\frac{L^2}{4} - R^2}\right).$$

One leg of the right triangle has length L/2 and the hypotenuse has length r. Let α denote the angle of the triangle of the wedge extending outward from the center.

$$\alpha = \cos^{-1}\left(\frac{L}{2r}\right) \tag{29}$$

Consider the arc of the circle swept out by a counter-clockwise rotation of π/4 radians (⅛ of the circle) from (r,0) to $$\left(\frac{r}{\sqrt{2}}, \frac{r}{\sqrt{2}}\right).$$

Angular displacements between 0 and α lie outside the square and angular displacements between α and π/4 lie inside the square.

Let f denote the fraction of ions with radial displacement r that are swept across the detector by the rotating deflection field.

$$f = \begin{cases} 1 & r \in \left[0, \frac{L}{2}\right] \\ 1 - \frac{4\alpha}{\pi} = 1 - \frac{4}{\pi}\cos^{-1}\left(\frac{L}{2r}\right) & r \in \left[\frac{L}{2}, \frac{L}{\sqrt{2}}\right] \\ 0 & r > \frac{L}{\sqrt{2}} \end{cases} \tag{30}$$

1/f is used as a correction factor for estimating the intensities of ions that lie in the extended mass range.

Estimates of Ion Intensities and Quantitative Accuracy

In this section, it is assumed that the intensities are low enough that there is no detector saturation. Later, estimates are provided for ion intensities that consider partial saturation.

Let I denote the true ion intensity in a given ring of radius R. Suppose an estimate $\hat{I}$ of the (unknown) ion intensity is formed by counting ions over a time interval of duration T. Let $N_{obs}$ denote the number of ions observed during this time interval. As $N_{obs}$ is the outcome of a counting process, it is a Poisson-distributed random variable with parameter Itf. This means that both the mean and variance of the random variable $N_{obs}$ are equal to Itf.

$$\langle N_{obs} \rangle = Itf \tag{31}$$

$$\sigma_{N_{obs}}^2 = \langle N_{obs}^2 - \langle N_{obs} \rangle^2 \rangle = Itf \tag{32}$$

An estimate of the ion intensity is formed by dividing the observed number of ions by the time duration and the geometric factor that depends upon the ring radius.

$$\hat{I} = \frac{N_{obs}}{tf} \tag{33}$$

The intensities estimated in this way are unbiased—that is, they give the actual ion intensity on average.

$$\langle \hat{I} \rangle = \frac{\langle N_{obs} \rangle}{tf} = \frac{Itf}{tf} = I \tag{34}$$

The variance in the estimate of 1 depends upon the both the duration of the time interval and the geometric factor.

$$\sigma_{\hat{I}}^2 = \frac{\sigma_{N_{obs}}^2}{(tf)^2} = \frac{Itf}{(tf)^2} = \frac{I}{tf} \tag{35}$$

The variance is reduced when more ions are observed either by increasing the observation duration or by moving the ring inward on the detector to increase the geometric factor f.

The Effect of Deflector Rotation Period

The mass resolving power of the analyzer is determined by the spread in the estimates of time-of-flight values for a given ion species. The time-of-flight measurement precision depends upon the precision of both the time of departure of the ion (through the deflector) and the time of arrival of the ion. Both time measurements are "gated" or quantized, meaning that a range of values around a center value cannot be distinguished from the center value.

The time of arrival was address'ed in a previous section describing the detector. In that case, the quantization arises from the frequency of a digital clock.

The time of departure is gated by the sweeping of the ion beam across a detector element. Imagine a beam consisting of a single ion species. The times of departure of any ion in the beam that falls anywhere within the detector element cannot be distinguished.

Errors in the departure time measurement arise from how long it takes for the entire beam to cross an entire detector element. Indeed, the earliest ion striking a detector element is one from the front edge of the beam striking the front edge of the detector element and the latest is one from the back edge striking the back edge.

$$\Delta T_{max} = \frac{s + b}{r} \tag{36}$$

The total transit time, and therefore the maximum uncertainty in the time-of-flight, is (s+b)/r where s is the diameter of a detector element, b is the diameter of the ion beam, and r is the rate at which the beam is swept across a detector element.

The distribution of arrival times is the convolution of the beam profile and the square profile of the detector element.

In general, the beam is expected to have an approximately Gaussian profile. A Gaussian profile arises from placing ions in a parabolic focusing potential and/or Boltzmann-Maxwell velocity distributions in thermal equilibrium.

The beam diameter is also expected to be significantly broader than a single element. In this case, the combined distribution is essentially Gaussian, and the total positional variance is the sum of the variances arising from the beam and the detector. The variance arising from the size of the detector element is $s^2/12$. (See Equation 7 above.) Let $b^2/4$ denote the beam variance—assuming that the spot diameter b corresponded roughly to its full width at half maximum.

The variance in departure time is the positional variance divided by the square of the sweep rate. For the magnetic deflector, the sweep rate is one circumference per rotation period.

$$r = \frac{2\pi R}{T_r} \tag{37}$$

Because the radial deflection is m/z-dependent, in cases where the precision in the time-of-flight measurement is limited by the sweep rate, the precision is m/z-dependent.

Combining the positional variance and the sweep rate:

$$\sigma_{T_d} = \frac{\sqrt{\frac{s^2}{12} + \frac{b^2}{4}}}{\frac{2\pi R}{T_r}} = \sqrt{\frac{s^2 + 3b^2}{12}}\,\frac{T_r}{2\pi R} \tag{38}$$

Suppose that the departure time measurement is the primary source of error in the time-of-flight. In this special case, the sweep-rate is limited, the mass resolving power and mass accuracy are mass-independent. Using Equation 5, substituting $\sigma_{T_d}$ for $\Delta T$ from Equation 38, and then substituting the right-hand side of Equation 15 for R, an expression is produced that depends only upon the operating parameters, as $\Delta T$ scales linearly with T.

$$\frac{m}{\Delta m} = \frac{1}{2}\frac{T}{\Delta T} = T\sqrt{\frac{12}{s^2 + 3b^2}}\,\frac{2\pi R}{T_r} = T\sqrt{\frac{12}{s^2 + 3b^2}}\,\frac{2\pi}{T_r}\,\frac{BdL^2}{2VT} = \sqrt{\frac{12}{s^2 + 3b^2}}\,\frac{\pi BdL^2}{VT_r} \tag{39}$$

Suppose that the z-axis is denoted as the direction of the ion beam and consider a magnetic field that rotates counterclockwise in the xy-plane. Consider an observer rotating synchronously with the deflector field, looking in the direction of the z-axis, watching an ion pass through the deflector. To the observer, the ion follows a helical path—moving with constant speed along the z-axis towards the detector and rotating clockwise (opposite the field rotation) in the xy-plane. From the point of view of the observer, all ions rotate in the xy-plane with the same angular velocity. Ions travel down the z-axis with different speeds. The lightest ions—more precisely, ions with the lowest m/z values—go the fastest and complete the fewest helical rotations before striking the detector. The heaviest ions are slower and complete more rotations before striking the detector.

Now consider the point of view of an observer sitting on the fixed detector. The natural choice of a coordinate system for this observer is to place the origin of the detector at the position where ions would strike if the deflector field is turned off, with the x-axis and y-axis aligned with the direction of the detector elements, and with the z-axis perpendicular to the detector and opposite the direction of the ion beam. This observer watches the deflector field move in the xy-plane in her coordinate system in a clockwise direction. In this coordinate system, an ion moves with constant velocity. The projection of the ion's velocity in the xy-plane is parallel to the direction that the deflection field was pointing at the instant the ion passed through the deflector.

A pulse of ions with various m/z values that pass through the deflector at the same instant strike the detector along a straight ray projecting out from the center of the detector. Lighter ions—more precisely, ions with lower m/z values—will arrive sooner and further from the center of the detector. Heavier ions arrive later and closer to the center of the detector.

Now consider a group of ions that strike the detector at the same time. The heaviest ions passed through the deflector much earlier than the lightest ions, but the lightest ions traveled much faster and caught up with the heaviest ions just as they all reach the detector. Because the ions left the deflector at different times, they arrive at various angular displacements on the detector. If the deflection field rotates clockwise in the detector's coordinate system, then a slightly heavier ion has a counterclockwise angular displacement (opposite the rotation of the deflector) relative to a slightly lighter ion because it passed through the deflector slightly earlier. In addition, the slightly heavier ion has an inward radial displacement relative to slightly lighter ion because it undergoes less deflection by the field.

If the times of flight of the ion are greater than the rotational period of the magnetic field, ions that strike the detector at the same time trace out a spiral pattern with multiple concentric rings. The m/z axis, moving from low m/z to high m/z, can be traced along the spiral, rotating counterclockwise while moving inward.

At the next instant of time, the entire pattern is rotated clockwise with the rotating deflection field. From the perspective of an observer who rotates clockwise in the plane of the detector, following the shadow of the deflection field, the spiral pattern is fixed. Indeed, all calculations of the time-of-flight are relative to this rotating coordinate system. That is, the angular displacements of ions striking the detector are measured with respect to the direction of the deflection field at their arrival time.

The angular displacement of the deflection field is like the hand of a stopwatch that measures the time-of-flight of ions. The displacement of this field during each ion's flight is determined by the difference between the ion's arrival position on the detector (the position of the deflection field when the ion passed through the detector) and the current position of the deflection field.

An interesting case to consider is two ions that strike the detector at the same time that lie at different radial displacements on the same ray from the detector origin. These ions have the same (relative) angular displacement, but they cannot have the same time-of-flight. If they had the same time-of-flight, they would also have the same m/z value, and would be deflected to the same radial position. Therefore, the time-of-flight values differ by an integer number of periods of the deflector field rotation. In fact, the difference in the number of periods can be easily determined by counting the number of rings of the spiral separating the two positions.

The Effect of Detector Element Dead Time

One last issue to consider for the analyzer that uses a rotating magnetic field to deflect ions is the effect of detector dead time. For low ion intensities, the ion intensity can be estimated as the ratio of the number of ions observed to the observation duration. For higher intensities, a correction is applied to account for the fact that some ions are not recorded because they arrive during the dead time for the detector element.

The first situation is potential saturation of the detectors by a single ion species of very high intensity. Consider ions A and B of the same species passing through the deflector with such a small time difference that A and B fall on the same detector element. If both ions could be recorded, w their departure times cannot be distinguished. Equation 36 gives the largest time difference that would allow ions A and B could land on the same detector element.

The effect can be essentially eliminated if the beam is swept fast enough that the average number of ions falling on a detector element per sweep I is considerably less than one.

$$\lambda = j\Delta t \tag{40}$$

If J denotes the ion flux in ions/second/pixel and Dt denotes the dwell time of the sweep on a pixel, then 1 denotes the average number of ions falling on a detector element per sweep.

The ion flux is the beam intensity divided by the effective cross sectional area of the beam.

$$\lambda = \frac{I}{\frac{\pi b^2}{4}} \frac{s+b}{r} = \frac{4I(s+b)}{\pi b^2 r} \tag{41}$$

In the case where the beam extends over several pixels, 1 moves inversely with b.

The distribution of the number of ions falling on the same detector element would be Poisson distributed with parameter I. Let $P_{collision}$ denote the probability that more than one ion would fall on the same detector element in the same sweep.

$$P_{collision} = 1 - e^{-\lambda}(1+\lambda) \approx \frac{\lambda^2}{2} \tag{42}$$

The approximation given in Equation 42 is valid for 1<<1. The sweep rate r is chosen to be high enough to ensure that 1<<1. Otherwise, there is no need to correct intensities to account for unrecorded ions events that arrival during the detector's dead time.

An additional factor comes into play because the spiral image of the mass spectrum is rotating. Consider two ion species A and B of different masses that can be resolved angularly, but whose masses are similar enough that their respective radial displacements on the detector are less than the beam diameter. Suppose that A is slightly lighter than B so that ions of type A arrive at the same detector element slightly earlier than ions of type B. If the difference in their respective arrival times is less than the detector dead time, then it is possible that ion of type A would be recorded on a detector element, but an ion of type B would not be recorded, as it falls in the shadow of A arising from the detector dead time.

If this effect is large and uncorrected, this factor could lead to distortions in quantitative ratios of ions that are adjacent in the spectrum. In particular, these distortions could affect isotope abundance ratios that are used for elemental composition determination or the ratios of reporter ion abundances that are used for multiplexed quantification of multiple samples.

To prevent this effect, the total number of ions from all ion species at a given radial displacement falling on a detector element from a given sweep must be considerably less than 1. That is, the constraints given by Equations 40 and 41 refer to the total ion flux and intensity of multiple ion species with a region of the mass spectrum, not just one ion species.

If the rotation period is chosen to be shorter the detector dead time, then an ion can fall within the "shadow" of an ion from an earlier sweep of the beam. In this case, the right hand side of Equation 41 is multiplied by the ratio of the detector dead time over the rotation period to account for the contributions of ions from multiple sweeps of the beam.

If sufficiently high ion intensities in a region of the mass spectrum are encountered to cause significant numbers of ions falling on dead detector elements, then an intensity correction needs to be applied. This correction is most easily applied to mass spectra as a post-processing step.

Consider the simplest case in which the rotation period is longer than the detector dead time. If NM counts of an ion of mass M were observed over an observation duration T, then the uncorrected intensity at mass M would be NM/T. To account for the ion events striking dead pixels, a correction factor is applied that accounts for the fraction of time Cm that the detector was rendered inactive by lighter ion reaching the detector earlier.

$$I_{corrected} = \frac{N_M}{T}\left(\frac{T}{T-\tau_M}\right) = \frac{N_M}{T-\tau_M} \tag{42}$$

To calculate $\tau_M$, the detector dead time $T_d$ is multiplied by the number of dead pixels that the beam passed over during the observation interval.

$$\tau_M = T_d \Sigma_{m=m_{min}}^{M} \rho(m,M) N_m \tag{43}$$

Where $N_m$ is the number of ions of mass m observed, ρ(m,M) is the normalized overlap between the radial beam profiles of mass M and mass m, and the sum is taken with respect to masses that have whose time-of-flight precedes M by less than the detector dead time (including M itself).

Synchronous Electric Field to Boost Radial Deflection

A magnetic field separates a population of ions with different mass to charge ratios that are accelerated by the same electric field. Increasing the magnetic field produces a proportional increase in the radial deflection. Larger deflection has several effects: 1) proportionately increasing the radial spacing between adjacent masses; 2) proportionately increasing the low-mass limit—the smallest nth where ions are deflected to the edge of the detector; 3) increasing the high-mass limit; 4) increasing the mass resolving power. Unfortunately, larger magnetic fields require greater power and thus greater demands for heat dissipation.

In various embodiments, an alternative way to produce some of the beneficial effects of a larger magnetic field is to add a rotating electric field that tracks the magnetic field. An electric field requires much less power to achieve a given deflection than a magnetic field. Application of an electric field increases the radial deflection of all ions by the same amount. By increasing the radial deflection, the low-mass limit can be increased without increasing the magnetic field.

The electric field does not change the radial separation between ions. However, by moving the ions to higher radius, two ions with a given difference in angular displacement (i.e., measured in radius), have a larger separation on the spiral (i.e., measured in distance), by virtue of the largest radius of each ring in the spiral. Greater separation of ions on the spiral is equivalent to an increase in mass resolving power when the rotational period is left unchanged.

Alternatively, the larger separation between ions achieved by boosting ions to higher radius can be offset by reducing the rotation frequency (of both the magnetic field and electric field) by a similar proportion. The separation along the spiral depends upon the product of the radius and the rotation frequency. Operating with a lower rotation frequency increases the spacing between adjacent rings of the spiral. Larger spacing between rings improves the reliability of the system as it makes it less likely that ions at the edge of the spiral is assigned to the wrong ring. This benefit is most important at the high end of the spectrum and thus extends the mass range.

Modulation of Rotation Period

The operation of the rotating magnetic field was previously described as employing a constant frequency. In this case, the spiral pattern representing the mass spectrum rotates as a fixed object. Pairs of m/z values that represent a time of flight difference of exactly one rotation period of the field have the same angular displacement and are separated by one ring of the spiral. The spacing between rings decreases with higher m/z, and the mass range is limited by the point at which these rings begin to overlap. Ions that strike in the region where two rings overlap cannot be assigned to the correct ring. Incorrect assignment results in errors in determination of the ion's time of flight, which translates to artifacts in the mass spectrum.

In various embodiments, an alternative mode of operation is to allow small, regular variations in the rotation period, i.e., from $T-\Delta T$ to $T+\Delta T$, where $\Delta T \ll T$. Two ions with a time of flight difference of T lie right across from each other on adjacent rings of the spiral. When the rotation period changes, the ions move along the spiral relative to each other. For example, when the rotation period changes to $T-\Delta T$, each ion is "paired" with an ion whose time of flight difference is $T-\Delta T$. Its previous partner, whose time of flight difference is T, now lies at an angular displacement of $\Delta T/T$. If R denotes the radial displacement and OR denotes the separation between rings. A small angular displacement, i.e., $\Delta T/T \sim \Delta R/R$, is sufficient to separate the overlapping ion spots.

At any instant in time, ions lying in a region of overlap between rings cannot be assigned to the correct ring. However, by considering a time sequence of images, and considering that the mass spectrum does not change rapidly with time, the movement of an ion over time as the rotation frequency is changing makes it easier to assign the ions to the correct ring.

Modulating the rotation period allows data to be collected with smaller spacings between adjacent rings of the spiral than would otherwise be possible by operating with a fixed rotation period. Tolerance of closer spacing between rings extends the upper limit of the mass range.

Deflection of Ions by an Electric Field

Suppose that a beam of ions was accelerated along an axial direction across a potential $V_{\parallel}$. An ion of charge z will have an axial kinetic energy Vz.

$$K_{\parallel}=V_{\parallel}z \tag{44}$$

Suppose that the ions encounter an electric field of magnitude E that is perpendicular to their axial direction of motion. Suppose that the electrical field is uniform over a region of axial extent d. The ions feel a force F whose magnitude is equal to the field E times the ion charge z and whose direction is the same as the direction of the field.

$$F=Ez \tag{45}$$

Assume that the field is uniform over a distance d along the axis of the initial direction of the beam. Then, the transaxial velocity, assuming that the initial transaxial velocity was zero before the ion entered the field, is computed by multiplying the ion's acceleration times $\Delta t$, the time the ion spends in the field.

$$v_{\perp} = \frac{Ez}{m}\Delta t = \frac{Ez}{m}\frac{d}{v_{\parallel}} = \frac{E}{m/z}\frac{d}{v_{\parallel}} \tag{46}$$

To show that the radial deflection is actually independent of m/z, $2\,V/v^2$ is substituted for m/z—i.e., solving for m/z in the axial kinetic energy equation.

The deflection angle of each ion depends upon the ratio of its transaxial velocity to its axial velocity.

$$v_{\perp} = \frac{E}{m/z}\frac{d}{v_{\parallel}} = \frac{E}{\frac{2V_{\parallel}}{v_{\parallel}^2}}\frac{d}{v_{\parallel}} = \frac{Ed}{2V_{\parallel}}v_{\parallel}. \tag{47}$$

The transaxial velocity is in direct proportion to the axial velocity. The ratio of transaxial velocity to axial velocity, the tangent of the deflection angle, is Ed/2V.

The x- and y-components of a time-varying field can be computed to achieve the desired deflection of ions to sweep the ion beam along any desired periodic path on the detector, including the circulant raster pattern described above. It is desirable to place the detector slightly offline from the undirected beam so that neutral particles miss the detector entirely.

System Using a Rotating Magnetic Field

Figure 6:
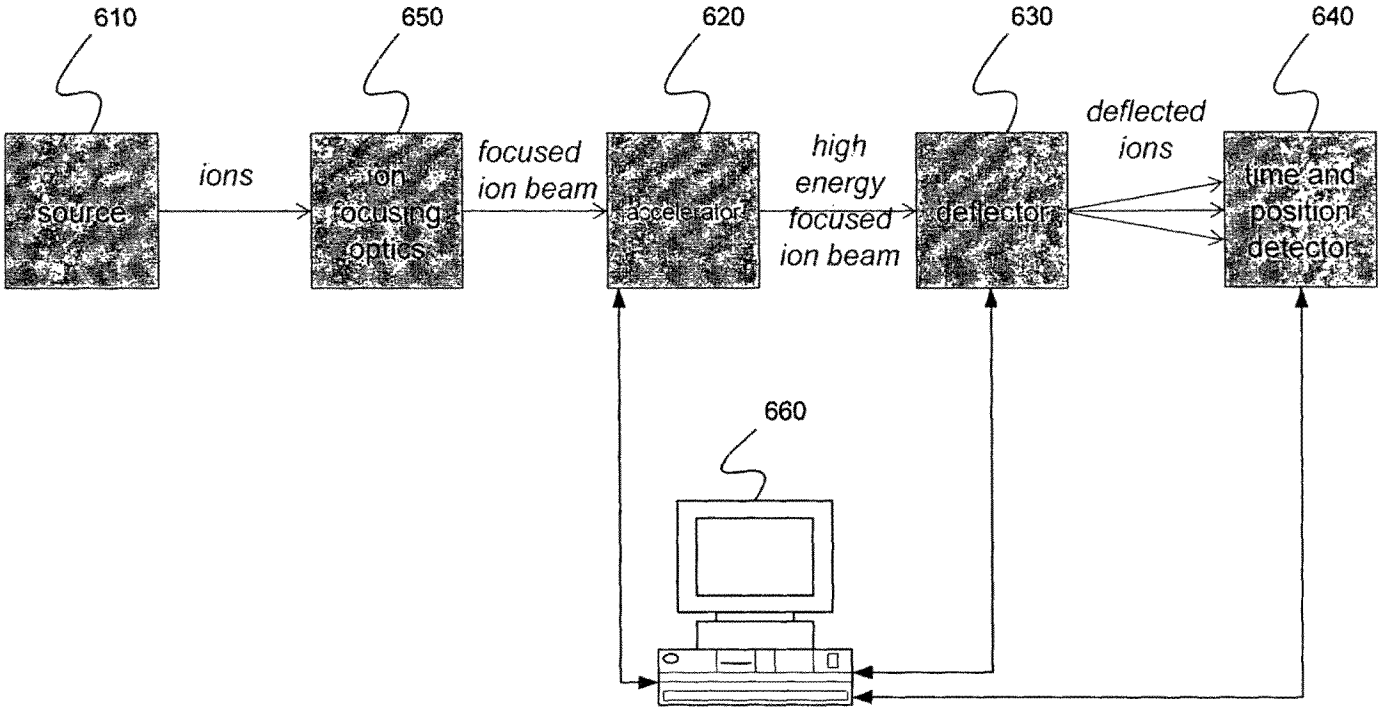
FIG. 6 is a schematic diagram showing a time-of-flight mass (TOF) spectrometer for analyzing a continuous beam of ions using a rotating magnetic field, in accordance with various embodiments.

FIG. 6 is a schematic diagram showing a time-of-flight mass (TOF) spectrometer 600 for analyzing a continuous beam of ions using a rotating magnetic field, in accordance with various embodiments. System 600 includes ion source 610, accelerator 620, deflector 630, and two-dimensional detector 640. System 600 can also include ion focusing optics 650 and processor 660.

Ion source 610 ionizes a sample producing a continuous beam of ions. Accelerator 620 receives the continuous beam of ions from ion source 610. Accelerator 620 can receive the continuous beam of ions through ion focusing optics 650, for example. Accelerator 620 applies an electric field to the continuous beam of ions producing an accelerated beam of ions. Two-dimensional detector 640 records an arrival time and a two-dimensional arrival position of each ion of the accelerated beam impacting two-dimensional detector 640.

Deflector 630 is located between accelerator 620 and two-dimensional detector 640. Deflector 630 receives the accelerated beam of ions from accelerator 620. Deflector 630 applies a rotating magnetic field to the accelerated beam to separate ions with different mass-to-charge ratios in the accelerated beam over an area of two-dimensional detector 640. The rotating magnetic field is rotated at a constant frequency, for example. In various alternative embodiments, the magnetic field is rotated with regular variations in the rotation period.

In various embodiments, deflector 630 includes coils of wire wrapped around a cylindrical core and receives the accelerated beam of ions through the center of the core.

In various embodiments, the rotating magnetic field of deflector 630 separates ions in the accelerated beam by magnetic deflection so that at any given instant the ions of the accelerated beam are arranged in a spiral pattern on two-dimensional detector 640. Ions of increasing mass-to-charge ratio are separated monotonically along the spiral pattern inward toward the center of the spiral pattern.

In various embodiments, the mass range of ions that are recorded by two-dimensional detector 640 and the mass resolving power of two-dimensional detector 640 are determined by the following operating parameters: the kinetic energy per charge applied by accelerator 620, the period of the rotating magnetic field, the field strength of the rotating magnetic field, the length of the region over which the magnetic field is applied, and the distance between deflector 630 and two-dimensional detector 640.

In various embodiments, deflector 630 further applies a rotating electric field to the accelerated beam that increases the deflection of each ion in the accelerated beam by the same radial displacement.

Processor 660 can be, but is not limited to, a computer, microprocessor, or any device capable of sending and receiving control signals and data. In various embodiments, processor 660 is in communication with accelerator 620, deflector 630, and two-dimensional detector 640. Processor 660 can be, for example, computer system 100 of FIG. 1.

Processor 660 receives an arrival time and a two-dimensional arrival position for each ion impacting two-dimensional detector 640. Processor 660 calculates a time-of-flight for each ion impacting two-dimensional detector 640 from the arrival time and the two-dimensional arrival position. Processor 660 performs this calculation, for example, by combining both radial and angular components of the two-dimensional arrival position with respect to the direction of the accelerated beam. The radial component provides the integer part of the time-of-flight measured in units of the rotation period of the magnetic field and the angular component provides the fractional part of the time-of-flight.

Method Using a Rotating Magnetic Field

Figure 7:
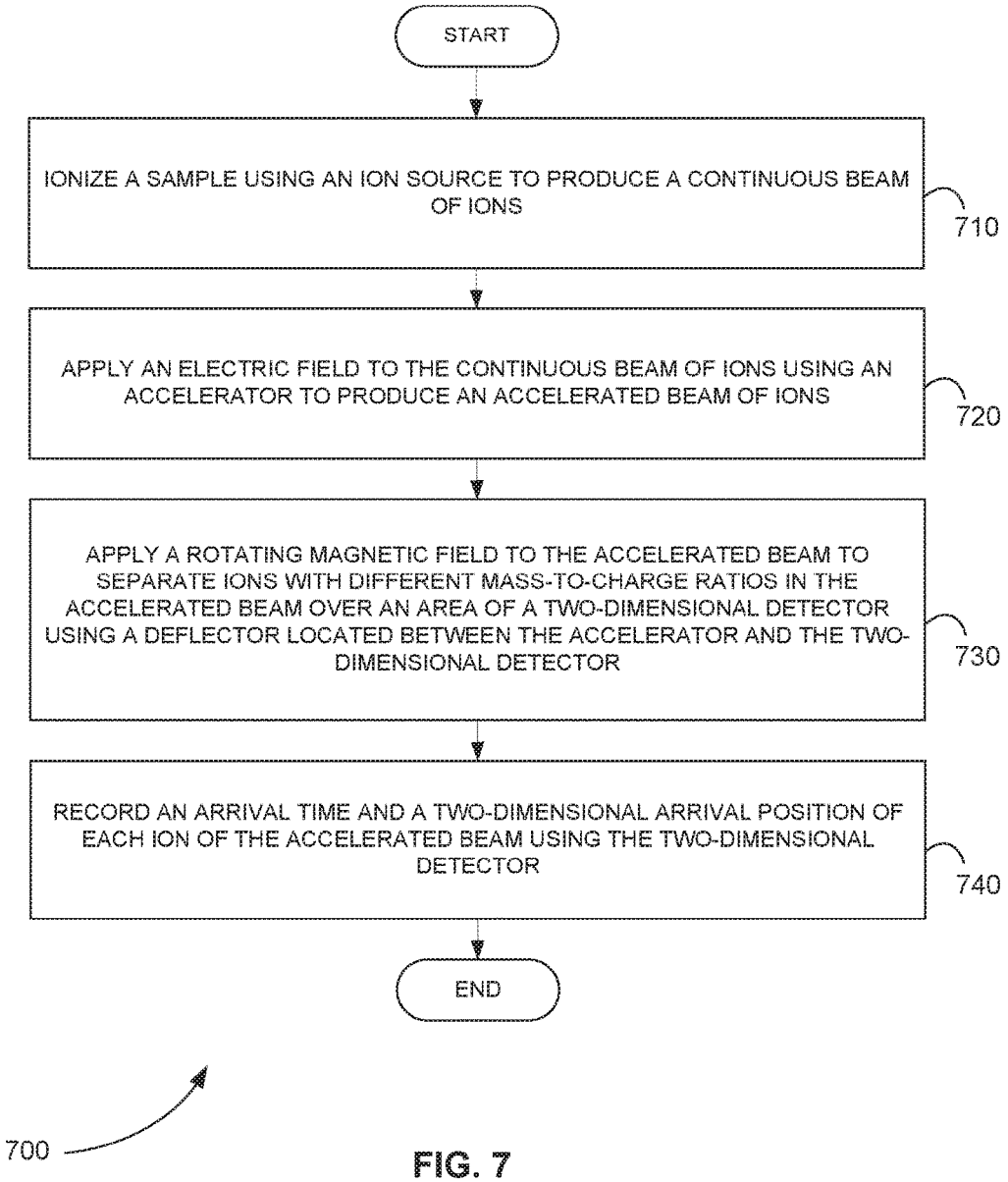
FIG. 7 is an exemplary flowchart showing a method for analyzing the time-of-flight of a continuous beam of ions using a rotating magnetic field, in accordance with various embodiments.

FIG. 7 is an exemplary flowchart showing a method 700 for analyzing the time-of-flight of a continuous beam of ions using a rotating magnetic field, in accordance with various embodiments.

In step 710 of method 700, a sample is ionized using an ion source to produce a continuous beam of ions.

In step 720, an electric field is applied to the continuous beam of ions using an accelerator to produce an accelerated beam of ions.

In step 730, a rotating magnetic field is applied to the accelerated beam to separate ions with different mass-to-charge ratios in the accelerated beam over an area of a two-dimensional detector using a deflector located between the accelerator and the two-dimensional detector.

In step 740, an arrival time and a two-dimensional arrival position of each ion of the accelerated beam are recorded using the two-dimensional detector.

System for Optimally Utilizing a Rectangular Detector Area

Figure 8:
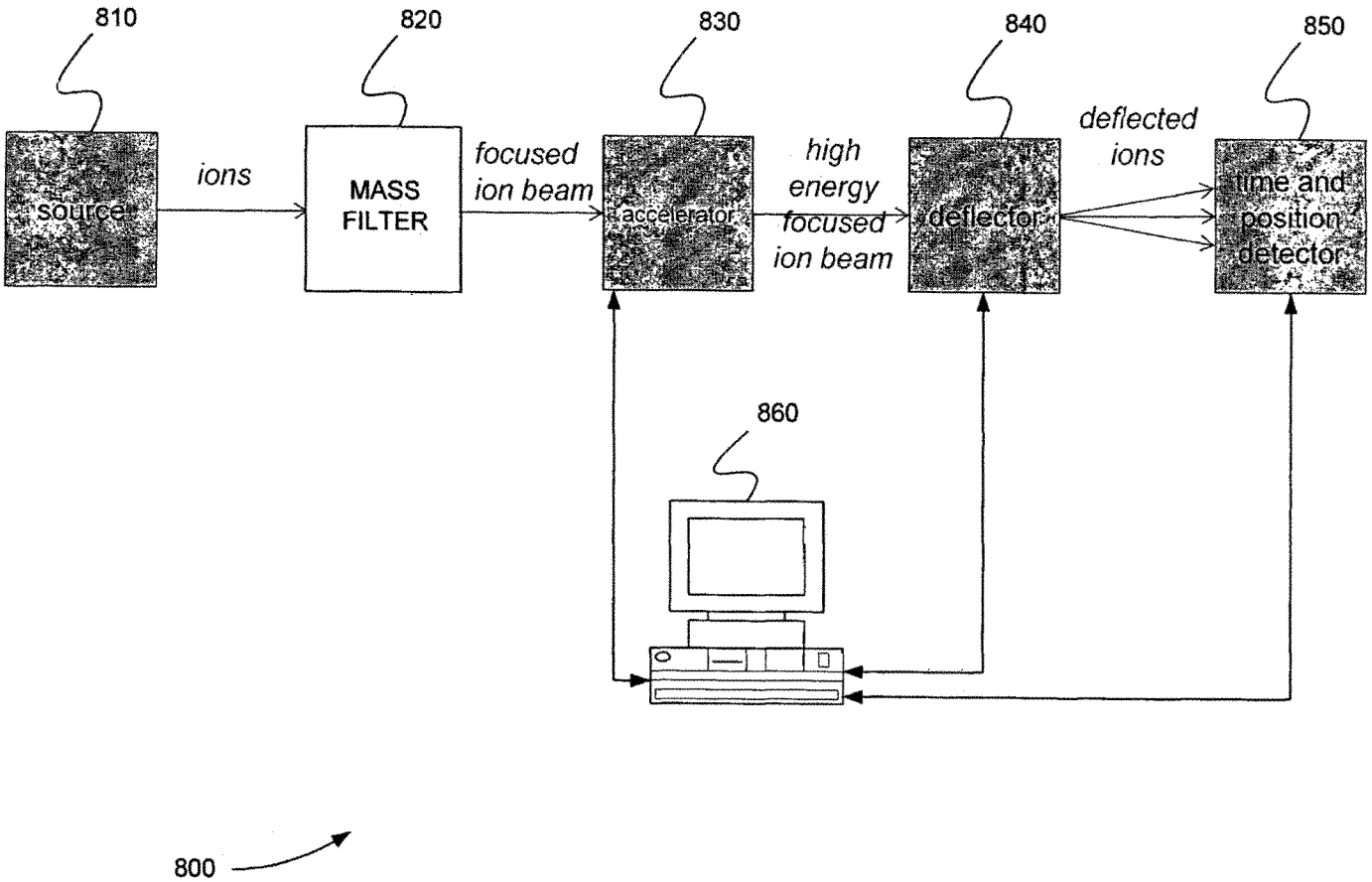
FIG. 8 is a schematic diagram showing a TOF spectrometer for analyzing a continuous beam of ions that optimizes the utilization of the area of a rectangular detector for analyzing a continuous beam of ions using a rotating magnetic field, in accordance with various embodiments.

FIG. 8 is a schematic diagram showing a time-of-flight mass (TOF) spectrometer 800 for analyzing a continuous beam of ions that optimizes the utilization of the area of a rectangular detector for analyzing a continuous beam of ions using a rotating magnetic field, in accordance with various embodiments. System 800 includes ion source 810, mass filter 820, accelerator 830, deflector 840, and two-dimensional rectangular detector 850. System 800 can also include processor 860.

Ion source 810 ionizes a sample producing a continuous beam of ions. Mass filter 820 receives the continuous beam of ions from ion source 810. Mass filter 820 admits ions with a desired range of mass-to-charge ratios and blocks ions outside the desired range producing a filtered beam. Mass filter 820 is a quadrupole, for example. Accelerator 830 receives the filtered beam of ions from mass filter 820. Accelerator 830 applies an electric field to the continuous beam of ions producing an accelerated beam of ions. Two-dimensional rectangular detector 850 records an arrival time and a two-dimensional arrival position of each ion—in the accelerated beam of ions.

Deflector 840 is located between accelerator 830 and two-dimensional rectangular detector 850. Deflector 840 applies an electric field that is periodic with time to the accelerated beam in order to sweep the accelerated beam over a periodically repeating path on two-dimensional rectangular detector 850. The repeat period is set to the difference in the times required for ions with the highest and lowest mass-to-charge ratios in the filtered beam to travel from deflector 840 to two-dimensional rectangular detector 850. The path has a maximum length among all paths that satisfies the following constraint: for any point x on two-dimensional rectangular detector 850, the intersection between a circular region of diameter s centered about x and the path contains no more than one segment, where s denotes the diameter of the accelerated beam's cross section measured at two-dimensional rectangular detector 850.

In various embodiments, the path has a raster pattern. For example, the path includes at least two parallel rows and each row is connected to an adjacent row by a semi-circular arc.

Processor 860 can be, but is not limited to, a computer, microprocessor, or any device capable of sending and receiving control signals and data. Processor 860 can be, for example, computer system 100 of FIG. 1. In various embodiments, processor 860 is in communication with accelerator 830, deflector 840, and two-dimensional rectangular detector 850.

Processor 860 receives an arrival time and a two-dimensional arrival position for each ion impacting two-dimensional rectangular detector 850. Processor 860 calculates a time-of-flight for each ion impacting two-dimensional rectangular detector 850 from the arrival time and the two-dimensional arrival position.

Method for Optimally Utilizing a Rectangular Detector Area

Figure 9:
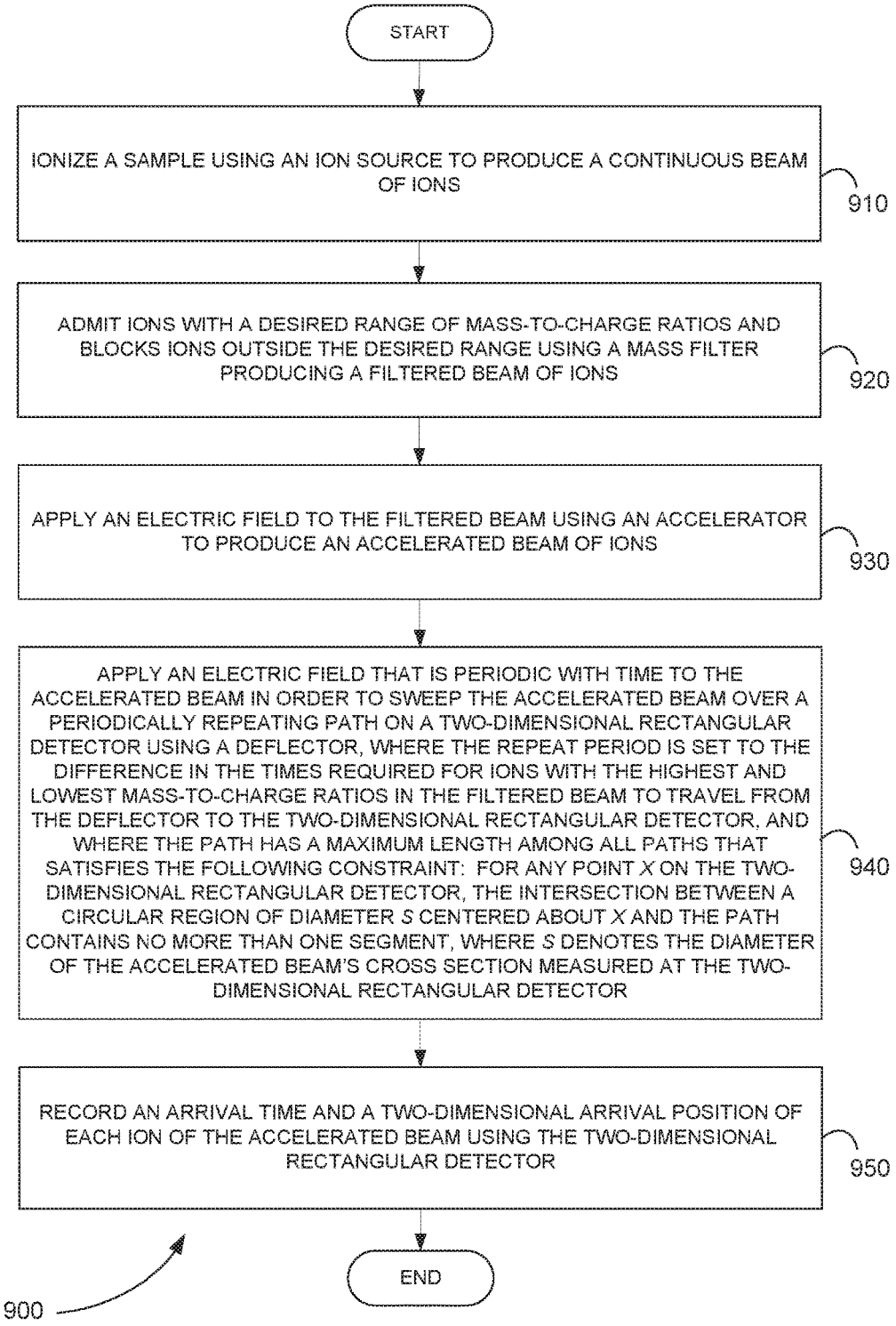
FIG. 9 is an exemplary flowchart showing a method for analyzing the time-of-flight of a continuous beam of ions using a rotating magnetic field, in accordance with various embodiments.

FIG. 9 is an exemplary flowchart showing a method 900 for analyzing the time-of-flight of a continuous beam of ions using a rotating magnetic field, in accordance with various embodiments.

In step 910 of method 900, a sample is ionized using an ion source to produce a continuous beam of ions.

In step 920, ions with a desired range of mass-to-charge ratios are admitted and ions outside the desired range are blocked using a mass filter producing a filtered beam of ions.

In step 930, an electric field is applied to the filtered beam producing an accelerated beam of ions.

In step 940, an electric field that is periodic with time is applied to the accelerated beam in order to sweep the accelerated beam over a periodically repeating path on a two-dimensional rectangular detector using a deflector. The repeat period is set to the difference in the times required for ions with the highest and lowest mass-to-charge ratios in the filtered beam to travel from the deflector to the two-dimensional rectangular detector. The path has a maximum length among all paths that satisfies the following constraint: for any point x on the two-dimensional rectangular detector, the intersection between a circular region of diameter s centered about x and the path contains no more than one segment, where s denotes the diameter of the accelerated beam's cross section measured at the two-dimensional rectangular detector.

In step 950, an arrival time and a two-dimensional arrival position of each ion in the accelerated beam are recorded using the two-dimensional rectangular detector.

Two-Dimensional Separation Using a Rotating Electric Field

A rotating electric field can also be used as a deflector to sweep ions in a circular path over a detector. In the simplest mode of operation, ions whose times of flights vary by up to one period of the rotating field can be separated angularly over the circle.

The mechanism of separation is as follows: Consider two ions A and B. A and B have the same charge and the same kinetic energy, and are traveling in the z-axis towards a rotating deflector field. A is slightly heavier than B. A and B pass through the deflector and strike the detector at the same instant. Because A is heavier than B and has the same energy, A has a lower axial velocity and thus takes a longer time to fly from the deflector to the detector. Because A and B strike the detector at the same time, A must have passed through the deflector earlier than B. After A passes through the deflector, the field rotates, and then B passes through the deflector. Therefore, ions A and B are separated angularly on the detector. The angular separation is $2\pi f\Delta T$ radians, where f is the rotation frequency of the field and $\Delta T$ is the difference in the times A and B pass through the deflector. Because A and B arrive at the detector at the same time, $\Delta T$ is also the difference in their times of flight.

Using angular separation alone, only times of flight over a range of one rotation period can be measured. Suppose the time of flight difference between A and B is $\Delta T=1/f$. The time of flight difference is equal to the period of rotation. The angular separation is $2\pi$ radians: the ions strike the same angular position on the detector because the deflection field completes a full rotation in the interval of time between A and B passing through the deflector.

To measure times of flight over a range greater than one rotation period, ions that have different times of flight but the same angular displacement (i.e., times of flight that are integer multiples of the rotation period 1/f) need to be radially separated. One embodiment of a rotating-field deflector that achieves the required radial separation is a magnetic field. Another embodiment of a rotating-field deflector that achieves the required radial separation is an electric field, but with the requirement that the transit times of ions through the deflector are a significant fraction of the rotation period (i.e., up to a full rotation period at the high end of the mass range).

As shown below, a fixed transaxial electric field deflects all ions with the same axial energy per charge to the same radial displacement on a downstream detector in a plane normal to the incident beam, independent of m/z. Likewise, an electrical field of fixed magnitude that rotates in the transaxial plane induces the same radial deflection in the limit where the ion's transit time through the deflector goes to zero.

In the general case, e.g., when the transit time is significantly different from zero, the ion feels the effect of the field integrated over the transit time. In the special case, when the transient time is one period of the rotation period (or any integer multiple of the rotation period), the time-averaged field is zero and the ion is not deflected, i.e., the radial deflection is zero. For ions that spend less than one period in the deflection field, the time-averaged magnitude of the field is less than the instantaneous magnitude of the field, but greater than zero, providing a radial deflection that decreases monotonically with transit time, and thus also decreases monotonically with m/z.

Consider a region of space that contains an electric field E that is constant in both time and space. Consider an ion traveling along the z-axis after having been accelerated from rest across an electrical potential difference V. The ion has a kinetic energy K=zV, where z denotes the charge on the ion.

$$K=zV \tag{48}$$

Suppose the electric field vector is parallel to the y-axis and that region of space containing the field has a length of d units along the z-axis $$E(t)=E\bar{y} \tag{49}$$

Then, the electric field imparts a constant force on the ion Ez over transit time $\Delta t$. Without loss of generality, time zero is set to the instant when the ion crosses the axial midpoint of the deflector.

$$F(t)=\begin{cases} Ez\bar{y}, & t\in\left[-\frac{\Delta t}{2},\frac{\Delta t}{2}\right] \\ 0, & \text{else} \end{cases} \tag{50}$$

The ion undergoes a constant acceleration Ez/m in the y direction.

$$a(t)=\begin{cases} \frac{Ez\bar{y}}{m}, & t\in\left[-\frac{\Delta t}{2},\frac{\Delta t}{2}\right] \\ 0, & \text{else} \end{cases} \tag{51}$$

Assuming the initial velocity has a y-component of zero, the y-component of the ion's velocity after it passes through the deflector, $v_y$, is $E/(m/z)\Delta t$.

$$v_y=\int_{-\frac{\Delta t}{2}}^{\frac{\Delta t}{2}}\frac{Ez\bar{y}}{m}dt=\frac{E}{m/z}\Delta t \tag{52}$$

It is shown that $v_y$ is proportional to $v_z$ and independent of m/z. First, the transit time is written in terms of the axial velocity, which remains unchanged by the deflector.

$$\Delta T=\frac{d}{v_z} \tag{53}$$

Next, the axial kinetic energy is written in terms of m/z and the axial velocity and solve for m/z.

$$K=zV=\frac{1}{2}mv_z^2 \tag{54}$$

-continued $$\frac{m}{z} = \frac{2V}{vz^2} \tag{55}$$

Equations 52, 53, and 55 are combined to produce the desired result.

$$v_y = \frac{E\bar{y}}{m/z}\Delta t = \frac{E\bar{y}}{\frac{2V}{v_z^2}}\frac{d}{v_z} = \frac{Ed}{2V}v_z \tag{56}$$

The tangent of the deflection angle is given by the ratio of the z and y components of velocity and depends only upon the accelerating potential V, and magnitude of the electric field E, and the distance over which the deflection field is applied.

$$\tan\theta = \frac{v_y}{v_z} = \frac{Ed}{2V} \tag{57}$$

This demonstrates a focused beam of ions with the same incident kinetic energy per charge is not separated by an electric field that is invariant over time.

The magnitude of the electrical field required can be calculated for a simple example. Suppose that the desired deflection is 0.01, i.e., 1 cm over a 1–m flight length. The ratio $v_y/v_z$ is 100 in this example, and the ratio of component energies is the square of the velocity ratio. If the axial component of the ion's kinetic energy is 10 kV, the transaxial component is 1 V. If the length of the deflector is 1 cm, then the deflection inside the deflector is ½ (1 cm/1 m) 1 cm=50 um. So, the electric field is 1 V/50 um=20 V/mm–20000 Newtons/C. For example, this deflection can be delivered using a parallel plates 1 cm long and separated by 5 mm by applying 100V across the plates.

Consider the situation above—a region of space that contains an electric field with a constant magnitude—but now modified so that the direction of the electric field rotates in the xy-plane with frequency f. To simplify the analysis, suppose that the ion passes through the midpoint of the region containing the electric field just as the field is oriented along the y-axis.

$$E(t)=E[\cos(2\pi ft)\bar{y}+\sin(2\pi ft)\bar{x}] \tag{58}$$

As in Equation 52 above, each velocity component of the ion is calculated by integrating the respective component of the acceleration induced by the electric field as the ion passes through the region. Here, the expression for the rotating field provided in Equation 58 is used and the calculation for both x and y components.

$$v_x = \int_{-\Delta T/2}^{\Delta T/2}\frac{F_x(t)}{m}dt = \int_{-\Delta T/2}^{\Delta T/2}\frac{E_x(t)z}{m}dt = \frac{E}{m/z}\int_{-\Delta T/2}^{\Delta T/2}\sin(2\pi ft)dt = 0 \tag{59}$$

The x-component of the acceleration is an odd function about time-zero (the midpoint of the region) and integrates to zero. Thus, deflection is parallel to the y-axis. In general, the azimuthal angle of the deflection depends only upon the position of the field as the ion passes through the midpoint of the deflection region.

From the standpoint of the azimuthal deflection, the deflection can be considered to be the result of instantaneous deflection by an ideal deflection field of infinitesimal axial extent placed at the midpoint of the actual detector. Thus, the analysis is simplified by using the midpoint of the detector as the start position for measuring the times of flight of ions.

The y-component of the velocity is calculated similarly.

$$v_y = \int_{-\Delta T/2}^{\Delta T/2}\frac{F_y(t)}{m}dt = \int_{-\Delta T/2}^{\Delta T/2}\frac{E_y(t)z}{m}dt = \frac{E}{m/z}\int_{-\Delta T/2}^{\Delta T/2}\cos(2\pi ft)dt = \frac{E}{m/z}\frac{\sin(\pi f\Delta T)}{\pi f} \tag{60}$$

The analysis above assumes that the field is constant with axial displacement. This assumption simplifies analysis, but is not strictly necessary. An approximation of the ideal field can be implemented using a pair of closely parallel plates held at opposite potentials. However, the transaxial component of the field is expected to be non-zero at small axial displacements from the edge of the field (i.e., edge effects). Even so, the concept of ion separation by field averaging is still perfectly valid. The same deflection of ions induced by a field with edge effects can be accomplished by an ideal field with a given "effective distance" over which a constant "effective field strength" is applied.

If the y-component of the velocity in the case of the static field is denoted as $v_y^0$ (See Equation 52), then the y-component of velocity for the rotating field $v_y$ is equal to $v_y^0$ times the average of the y-component of the field over the transit time.

$$v_y = \left(\frac{E}{m/z}\Delta T\right)\left(\frac{1}{\Delta T}\int_{-\Delta T/2}^{\Delta T/2}\cos(2\pi ft)dt\right) = v_y^0\left(\frac{1}{\Delta T}\int_{-\Delta T/2}^{\Delta T/2}\cos(2\pi ft)dt\right) = v_y^0\frac{\sin(\pi f\Delta T)}{\pi f\Delta T} \tag{61}$$

When an ion is accelerated across a potential difference V, its kinetic energy is zV (Equation 54). Its axial velocity is determined by solving for m/z in the kinetic energy equation.

$$v_z = \sqrt{\frac{2V}{m/z}} \tag{62}$$

The transit time of an ion through the deflector can be calculated using the transit time equation (Equation 53) and the axial velocity (Equation 62).

$$\Delta T = \frac{d}{v_z} = d\sqrt{\frac{m/z}{2V}} \tag{63}$$

Because the transit time depends upon m/z and the radial deflection in a rotating electric field is dependent upon transit time, ions can be radially separated by m/z by virtue of their varying transit times in a rotating electric field. In light of this observation, the equation for the y-component of the velocity (Equation 61) is rewritten in terms of a radial separation function g. The unitless parameter, x, is also introduced to denote the transit time in units of the rotation period fΔT.

$$v_y(x) = v_y^0 g(x) \tag{64}$$

$$g(x) = \frac{\sin(\pi x)}{\pi x} \tag{65}$$

$$x = f\Delta T \tag{66}$$

In the case where x is small (for the entire mass range), the transit time through the region is so short that the field hasn't changed significantly.

$$\lim_{x\to 0} g(x) = \lim_{x\to 0} \frac{\sin(\pi x)}{\pi x} = 0 \tag{67}$$

This case is not useful for mass analysis because there is no radial separation of ions by the rotating field.

Plots of the radial separation function g and its first derivative provide insight about how to achieve optimal radial separation using a rotating field.

$$g'(x) = \frac{d}{dx}\frac{\sin(\pi x)}{\pi x} = \frac{\cos(\pi x)}{x} - \frac{\sin(\pi x)}{\pi x^2} \tag{68}$$

Figure 10:
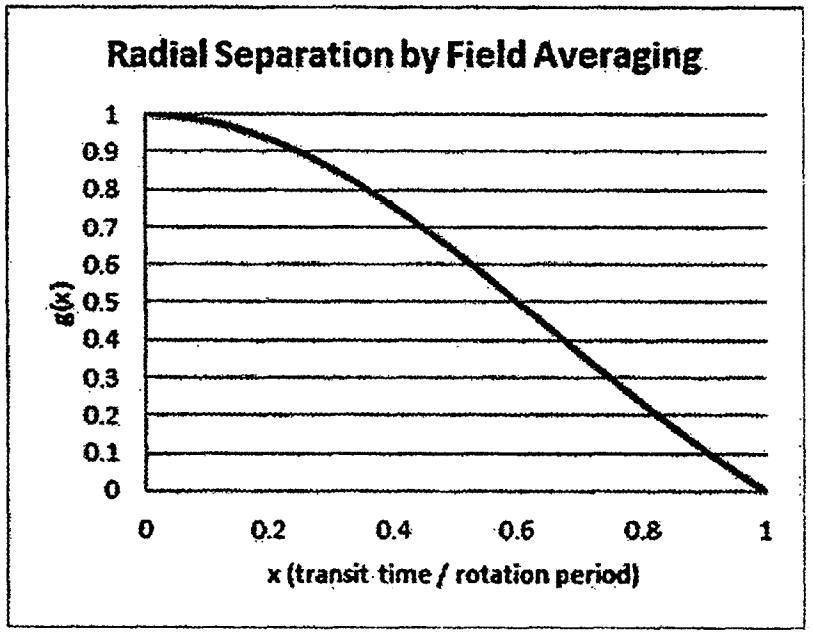
FIG. 10 is an exemplary plot that shows the normalized radial deflection of ions that have transit times ranging from 0 to 1 rotation periods in a rotating electric field, in accordance with various embodiments.

FIG. 10 is an exemplary plot 1000 that shows the normalized radial deflection of ions that have transit times ranging from 0 to 1 rotation periods in a rotating electric field, in accordance with various embodiments.

Figure 11:
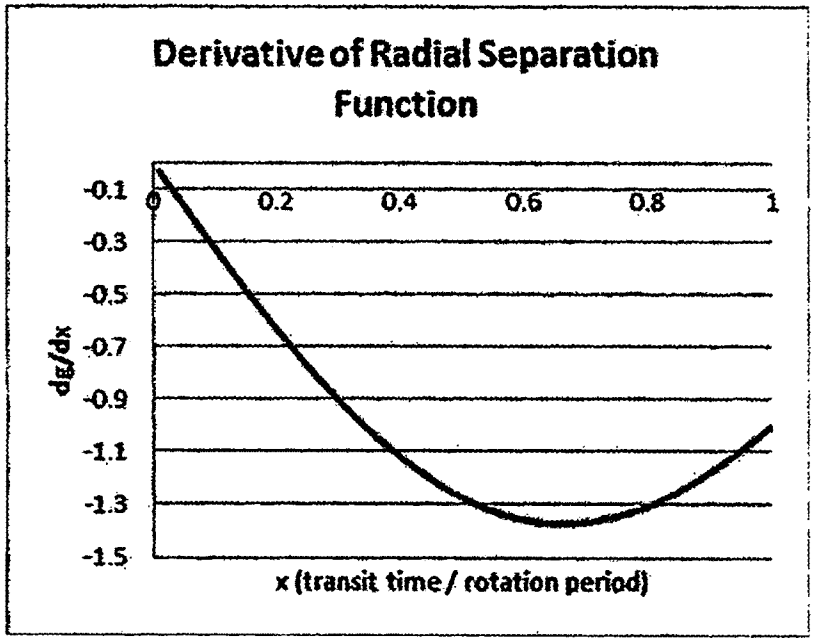
FIG. 11 is an exemplary plot that shows the rate of change of the normalized radial deflection of ions with respect to transit time measured in units of the rotation period that have transit times ranging from 0 to 1 rotation periods in a rotating electric field, in accordance with various embodiments.

FIG. 11 is an exemplary plot 1100 that shows the rate of change of the normalized radial deflection of ions with respect to transit time measured in units of the rotation period that have transit times ranging from 0 to 1 rotation periods in a rotating electric field, in accordance with various embodiments.

g(x) has a point of inflection at approximately 0.67. In the region around the point of inflection, the radial separation function is approximately linear in x.

Because the axial velocity is constant (ignoring the effects of unintended axial components at the edges of the deflector field), an ion's flight time measured between any two points is simply linear in the flight distance. The distance from the axial midpoint of the deflector to the detector is denoted as L and the ion's time of flight across this distance as L.

$$T = \frac{L}{v_z} = \frac{L}{d/\Delta T} = \frac{L}{d}\Delta T \tag{69}$$

Let R denote the radial deflection of the ion on the detector.

$$R(x)=v_y(x)T=v_y{}^0 g(x)T=R^0 g(x) \tag{70}$$

$R_0$ denotes the radial deflection of ions that have infinitesimal transit times.

As with any rotating field that separates ions both radially and angularly, coincident ions lie on a spiral. Ions that lie at the same angular displacement, but on different rings of the spiral, have flight time differences equal to an integer multiple of the rotation period of the field. The flight time of each ion is determined by mapping the ion to one of the rings of the spiral. Ions do not lie precisely on the spiral because of the imperfect focusing of the beam on the detector. To map each detected ion onto the correct ring of the spiral, any pair of adjacent rings needs to be separated by at least one beam diameter. The operating constraint is applying to the closest spaced pair of rings. When pairs of rings are separated by more than the beam diameter, detector area is wasted, reducing mass resolving power and/or mass range.

To maximize analyzer performance, it is desirable to have uniform spacing between any pair of adjacent rings so that the available area of the detector can be filled. In the linear region of the radial separation function, adjacent rings of the spiral have (approximately) uniform spacing, allowing utilization of the detector area to be optimized.

To illustrate a situation in which a spiral with essentially uniform spacing (e.g., a segment of an Archimedes spiral) can be constructed, consider the values of x in the region around the inflection point. For example, consider the region of x values ranging from 0.6 to 0.72. To illustrate the use of radial separation in mass analysis, suppose ions whose times of flight vary by a factor of 1.2 are analyzed. The analyzer is operated so that the fastest ions (lowest m/z values) have transit times of 0.6 rotation period and that slowest ions (highest m/z values) have transit times of 0.72 rotation periods. This range of flight times corresponds to a range of m/z values, so that the highest m/z value is 1.44 times of the lowest m/z value. This mass range is unacceptably small for most applications, but is chosen just to illustrate the principle of mass analysis.

To maximize the use of the detector, the magnitude of the electric field is chosen to deflect ions with the lowest m/z values to the edge of the detector. Ions with higher m/z values (up to x=1) have smaller radial deflections, so all the ions in the desired mass range are guaranteed to be detected. The detector consists of an array of 2×2 TimePix3 chips, for example. Suppose each chip is square with p pixels on each side. TimePix3 is a chip with an array of 256×256 square pixels, where each pixel is 55 μm on a side. To deflect the lowest mass ions to the each of the detector, $R_0$ is set to p/g(0.6). g(0.6)~0.505, so $R_0$~256/0.505~507. To provide an equation for the general case, the x value chosen for the low-mass limit is denoted as $x_L$.

$$R_0 = \frac{p}{g(x_L)} \tag{71}$$

Now, the analyzer is operated so that all rings of the spiral are separated by at least one beam diameter. The beam diameter is denoted as the diameter of the beam spot on the detector.

Adjacent rings of the spiral correspond to a time of flight difference of one rotation period 1/f. The difference in transit times between ions on adjacent rings of the spiral is 1/f*d/L (See Equation 69.) The difference in x values for ions on adjacent rings of the spiral is f times the difference in transit times.

$$\Delta x = f\left(\frac{1}{f}\frac{d}{L}\right) = \frac{d}{L} \tag{72}$$

The radial separation between two rings with transit times corresponding to x and x+Δx can be approximated using a first-order Taylor series.

$$\Delta R(x)=R^0 g(x+\Delta x)-R^0 g(x)\cong R^0{}_g{}'(x)\Delta x \tag{73}$$

For all x in the range 0.6 to 0.72, the ring spacing is requited to be greater than or equal to the spot diameter.

$$\Delta R(x)\geq s \tag{74}$$

For the range of x values we've chosen, the smallest value of $|g'(x)|$ is −1.36 at x=0.6. To satisfy Equation 74, there is a constraint on Δx.

$$\Delta x = \frac{s}{R^0|g'|_{min}} = \frac{s}{p}\frac{g(x_L)}{|g'|_{min}} \tag{75}$$

The latter expression for Δx in Equation 75 comes from Equation 71, and provides the interpretation that the optimal value for Δx is related to the number of beam spots across the chip and values of g and g' in the chosen operating range for x.

Equation 72 shows that Δx is also equal to the ratio of the deflector length to the ion flight length over which time of flight is measured. So, the constraint of placing the rings as close together as possible determines the geometry of the analyzer. Here, L/d is approximately 172.

$$\frac{d}{L} = \frac{p}{s}\frac{|g'|_{min}}{g(x_L)} \tag{76}$$

The mass resolving power of the analyzer, as a function of x, is determined as soon as d/L is chosen. Recall that x maps monotonically onto the chosen mass range, whatever it might be. In this case, x=0.6 for the lowest mass and x=0.72 for the highest mass, i.e., 1.44*the lowest mass.

It can be shown that the mass resolving power is ½ the "time resolving power".

First, the equation for the transit time through the deflector (Equation 63) is modified by substituting L for d, substituting T for ΔT, so that now the equation refers to the time of flight measurement, and squaring both sides to simplify subsequent calculations.

$$T^2 = L^2\frac{m/z}{2V} \tag{77}$$

Next, both sides of Equation 77 are implicitly differentiated.

$$2TdT = \frac{L^2}{2V}d(m/z) \tag{78}$$

Then, Equations 77 and 78 are combined.

$$2TdT = \frac{T^2}{m/z}d(m/z) \tag{79}$$

Finally, the desired result is achieved by rearranging Equation 79.

$$\frac{m/z}{d(m/z)} = \frac{1}{2}\frac{T}{dT} \tag{80}$$

The left-hand side of Equation 80 is the mass resolving power. The right-hand side contains the "time resolving power", where dT represents the time difference of the smallest resolvable difference between ions with distinct m/z values.

In this case, considering just geometric factors related to the rotating electric field, and ignoring other confounding factors such as the precision in the time measurement and dispersion in axial velocities, the smallest resolvable difference between ions with distinct m/z values corresponds to the time required for the entire beam to sweep across an entire pixel. The beam must travel its diameter plus the length of a pixel, i.e., s+1 pixels. The sweep velocity is the circumference of the ring divided by the rotation period, 1/f.

$$dT = \frac{s+1}{2\pi Rf} \tag{81}$$

The time of flight can be expressed as multiple, namely L/d, of the transit time. In light of Equation 66, the transit time is x/f.

$$T = \frac{Lx}{df} \tag{82}$$

The mass resolving power is calculated, as a function of x, by combining Equations 80, 81, and 82.

$$\frac{m/z}{d(m/z)}(x) = \frac{1}{2}\frac{T}{dT} = \frac{1}{2}\frac{Lx}{df}\frac{2\pi Rf}{s+1} = \frac{L}{d}\frac{\pi}{s+1}xR(x). \tag{83}$$

The expression for mass resolving power is further developed by using Equations 70 and 71 to express R(x) and $R_0$ in terms of operating parameters, regrouping related factors, and expanding g(x) using Equation 65.

$$\frac{m/z}{d(m/z)}(x) = \frac{L}{d}\frac{\pi}{s+1}xR(x) = \frac{L}{d}\frac{\pi}{s+1}x[R_0g(x)] = \frac{L}{d}\frac{\pi}{g(x_L)}x\left[\frac{p}{g(x_L)}\right]\left[\frac{\sin(\pi x)}{\pi x}\right] = \frac{L}{d}\frac{p}{s+1}\frac{\sin(\pi x)}{g(x_L)} \tag{84}$$

Interestingly, the frequency of rotation cancels out of the mass resolving power equation. Likewise, the acceleration potential and the time of flight do not appear (directly) in the mass resolving power equation. These parameters are encapsulated in the unitless parameter x. For a given set of operating parameters, the mass resolving power varies over the range of x values, i.e., $(m/z)^{1/2}$, as sin(πx).

The maximum value resolving power occurs at x=0.5. In the example above, the mass resolving power decreases with x because the region is above x=0.5.

The (theoretical) mass resolving power for this example is plotted below.

Figure 12:
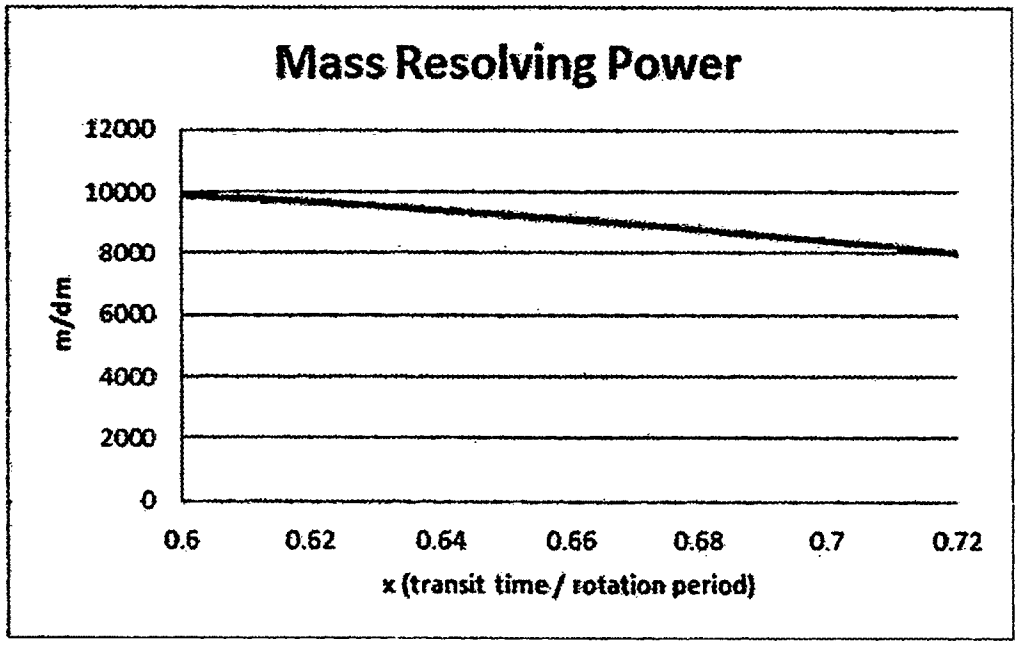
FIG. 12 is an exemplary plot that shows the mass resolving power for the mass analysis of ions that have transit times ranging from 0.6 to 0.72 rotation periods in a rotating electric field, in accordance with various embodiments.

FIG. 12 is an exemplary plot 1200 that shows the mass resolving power for the mass analysis of ions that have transit times ranging from 0.6 to 0.72 rotation periods in a rotating electric field, in accordance with various embodiments.

Because a range of x values is chosen for which g(x) is nearly linear, the detector utilization is nearly ideal: 20.6 rings are traced out over a radial distance of 83 pixels, from 256 down to 173. The average spacing between rings is 4.03 pixels.

To complete this example, values for d and L are chosen, satisfying L/d=172. For example, d=1 cm L=1.72 m. These values serve only to scale the time of flight.

Any mass range can be analyzed, satisfying m/z max=1.44 m/z min. For example, m/z 500 to m/z 720 is chosen. An acceleration potential V=10 kV is chosen. This choice of V gives flight times ranging from 27.7 us to 33.3 us.

The choice of m/z min and the acceleration potential V, together with the deflector length d, determines the transit time of the fastest ion through the deflector (Equation 63, listed below again).

$$\Delta T = \frac{d}{v_z} = d\sqrt{\frac{m/z}{2V}} \tag{63}$$

Because f=x/←T, and ΔT is known for the fastest ion and x=0.6 for the fastest ion, the frequency of the rotating field is determined.

$$f = \frac{x}{\Delta T} = \frac{x}{d}\sqrt{\frac{2V}{m/z}} \tag{85}$$

In this example, the transit time of an ion of m/z 500 is 0.19 us. A field rotation frequency of 3.1 MHz equates the ion transient time to 0.6 rotation periods.

It may be desirable to analyze a lower mass range, e.g., m/z 125 to 180. Keeping in mind that masses four times less have flight times (and transit times) two times shorter, the rotation frequency can be increased by a factor of 2, the acceleration potential can be increased by a factor of 4, or both L and d can be increased by a factor of 2. Any of these changes may place the new mass range at the same range of x values as before, i.e., 0.6 to 0.72. As different combinations of operating parameters produce indistinguishable theoretical performance, the parameter values can be chosen to optimize cost or other engineering criteria.

In this example, only a small mass range is analyzed, ranging over a multiple of 1.44. The mass range can be expanded by choosing a broader range of x values. In the example above, the upper range of x is limited by the decreasing slope of g(x), so that for x>0.72, adjacent rings are closer together than one spot diameter. At the high end, x may be limited by the decline in resolution; resolution decreases monotonically with x above x=0.5 and falls to zero at x=1 where the radial deflection is zero. Even before that, x>0.81 has the potential problem that g(x) maps values for x>1 to the same radial deflections. Unless ions of longer transit times (i.e., higher m/z) are explicitly filtered upstream by a quadrupole mass filter, the flight times of ions cannot be determined unambiguously.

Equation 76 provides the constraints on $x_L$, the lowest value of x for which mass analysis can be performed. The values of g and g' are fixed by nature. The other "levers" available are the ratio p/s—the number of spots that can fit along the length of a detector chip—and the ratio L/d—the ratio of the ion's flight distance from deflector (midpoint) to detector to the length of the deflector.

The ratio of p/s can be increased either by increasing the size of the detector or by improving the beam focusing to reduce the spot diameter. Indeed, increasing the ratio of p/s not only widens mass range, but as shown in the mass resolving power equation (Equation 83), increases the mass resolving power at any value of x operated at. So, it can be assumed that p/s was already made as large as possible.

After maximizing p/s, the only way to broaden the mass range is to choose a smaller value of L/d. Equation 76 above indicates the maximum value of L/d that allows analysis of ions with a particular value of x. Larger values of L/d do not provide separations as large as the beam diameter.

Unfortunately, L/d is not a tunable parameter; it is determined by the construction of the analyzer. However, one could imagine a segmented deflector, possibly with segments of varying lengths, in which certain segments can be switched off adaptively to step L/d over multiple discrete values. Increasing L/d analyzes narrower mass ranges and higher resolving power; while decreasing L/d (by turning on more segments or longer segments) analyzes wider mass ranges, but at the cost of reducing the resolving power.

The properties of g(x) introduce some interesting properties for different choices of operating intervals of x. One interesting property is that resolving power achieves its maximum at x=0.5, the maximum of xg(x)=sin(πx). Another interesting property is that xg(x), and thus the mass resolving power, is symmetric about x=0.5. So, one can guarantee that the entire mass range achieves a minimum resolution by choosing a range of x values that is symmetric about 0.5.

To demonstrate these properties, consider the range of values x=0.25 to x=0.75. Because the transit time and thus the time of flight ranges over a factor of 3, the accessible m/z ranges over a factor of 9, suitable for many applications. The value of L/d that allows analysis of ions with x=0.25 is approximately 110. After scaling the electric field so that ions with x=0.25 are deflected to the edge of the detector, time-averaging in the electric field provides just enough separation that ions in the adjacent ring lie one beam diameter apart at the edge of the detector, and have slightly greater separation everywhere else in the spiral.

The spacing between rings is controlled by g', the derivative of the radial separation function g. For x<0.67, g'(x) falls monotonically from zero, becoming more negative. Up to x=0.67, the spacing between adjacent rings of the spiral increases monotonically. For x>0.67, the spacing between rings begins to contract until g' is −1 at x=1. If $x_L$ is chosen to be less than 0.35, as in this example, then the minimum separation between rings occurs at $x_L$. This means that if L/d is chosen to provide the required separation of adjacent rings at 0.35, rings have sufficient separation for all values of x up to x=1.

The mass resolving power for this range of x values (assuming p=256 and s=2) is plotted below. The mass resolving power ranges from 7400 at the ends to 10400 in the middle (the average TOF). When the end points of the x range are equidistant from 0.5, the mass resolving power is the same at the two ends, rising monotonically to a peak at x=0.5 and falling symmetrically on the other side of the peak.

Ions with values of x above 0.75 are also arranged in the same spiral and have ring separation greater than the beam diameter, making them suitable for mass analysis. However, their resolution falls below 7400. A high-mass cutoff can be imposed by simply ignoring ions inside a circle whose radius corresponds to the highest desired mass. If a full decade of mass is required, ions with masses up to x=0.8 can be included in forming the mass spectrum. The region x=0.75 to x=0.8 is shown as the dashed segment in the curve. Mass resolving power falls from 7400 to 6100 in this region.

Figure 13:
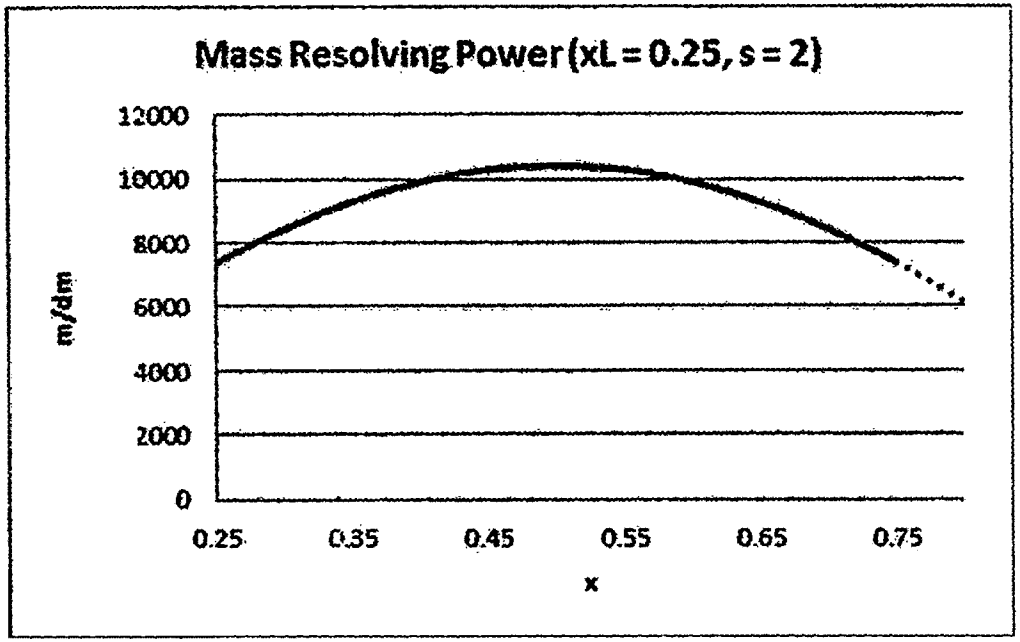
FIG. 13 is an exemplary plot that shows the mass resolving power for the mass analysis of ions that have transit times ranging from 0.25 to 0.8 rotation periods in a rotating electric field, in accordance with various embodiments.

FIG. 13 is an exemplary plot 1300 shows the mass resolving power for the mass analysis of ions that have transit times ranging from 0.25 to 0.8 rotation periods in a rotating electric field, in accordance with various embodiments.

At x>0.81, another interesting effect occurs. Ions with transient times greater than the rotation period, i.e., x>1, have radial deflections that overlap with the radial deflections of ions with values of x in the region 0.81 to 1. Thus, there is the potential to misinterpret heavier ions, outside the desired mass range, as lighter ions that are in the desired range. This problem can be eliminated by applying a quadrupole mass filter to block high-mass ions whose x values are greater than 1. If ion filtering is used to eliminate potential radial overlaps, the user can include ions up to x=1, although the resolution falls rapidly to zero.

After the range of x values is chosen to be 0.25 to 0.75 (or any suitable 3-fold range), analysis of any mass range spanning a factor of 9 can be analyzed, i.e., 100 to 900 or 200 to 1800. The mass range is chosen by choosing appropriate values for the operating parameters—the electric field E, rotation frequency f, the analyzers length L and d (subject to the constraint on L/d), and the acceleration potential V—to deflect the low mass to the edge of the detector and to place the low mass ions in the deflector for the required number of periods of the rotating field, e.g., 0.25.

The extent of beam focusing is critical for mass resolving power. The mass resolving power for s=4 has the same shape as the plot below, except that all values are reduced by a factor of 4(4+1)/2(2+1)=3.33. A reduction in the beam diameter allows a proportionate increase in the value of L/d for ring separation and mass resolving power scales in proportion to L/d. In addition, reducing the beam diameter also reduces the smallest resolvable time difference by a factor that depends upon $(s_0+1)/(s+1)$, where so is the previous beam diameter and s is the new beam diameter after improved focusing. The mass resolving power is increased by this same factor.

The analysis above considers the ideal case which is not limited by the detector. In practice, the mass resolving power cannot be increased indefinitely by simply increasing the beam focusing. However, it is important to consider that improvements in semiconductor technology will push these limits out further and further to the point where other factors, especially beam focusing, limit performance.

The pixel granularity and the clock granularity impose upper limits on how precisely time can be measured, and thus m/z. As the beam focus approaches one pixel, additional gains in focusing do not translate to gains as the square of the focusing improvement. One factor, the improvement in the time accuracy due to the reduced spot size scales like $(s_0+1)/(s+1)$, where so and s denote spot diameters measured in pixels before and after an improvement in focusing. The apparent broadening of the spot diameters by one pixel reflects the fact that resolving two distinct beam positions involves sweeping the entire beam across an entire pixel. The improvement in resolving power that comes from increasing the angular separation by operating at a higher rotation frequency is capped when the spacing between rings reaches one pixel; smaller ring separations cannot be resolved no matter how tightly the beam is focused.

The clock granularity introduces an additional component of additive variance in the time measurements. The root-mean-squared error due to TimePix3 clock granularity is about 450 ps. This factor starts to become limiting at resolving power of 10 k at the low-mass limit (flight times of 10 us) and 40 k at the high-mass limit (flight times of 40 us).

As noted in the analysis, the aspects of the mass resolving power that involve mapping the mass spectrum onto the detector are governed by the geometry of the analyzer. For example, these aspects are independent of the absolute values of the times of flight. For example, times of flight can be extended by increasing the deflector length and flight path in proportion or reducing the acceleration potential. With longer times of flight, loss of resolving power from uncertainty in time measurements from clock granularity is reduced.

Not surprisingly, there is also a trade-off for lengthening flight times. The transaxial dispersion of the beam will increase over longer flight times, requiring deflector and focusing elements with larger orifices and higher fields that require higher mechanical tolerances.

Dispersion in axial energy cannot be distinguished from spread in m/z. Time of flight measurements provide ratios of m/z to axial energy. See Equations 62 and 63, for example. The mass resolving power m/dm can be no greater than the "energy resolution" K/dK. The axial energy spread dK is typically independent of the acceleration potential. So, using larger acceleration potentials increases the energy resolution. Energy resolution is not expected to be a limiting factor until 30 k-60 k resolving power is reached.

Performance may also be limited by limitations in the achievable values of certain operating parameters. As the beam focusing is improved, it would be desirable to operate at increasingly higher values of L/d to improve the mass resolving power. However, increasing L increases the size of the instrument or requires multi-turn geometry, which increases cost and complexity and reduces ion transmission. The alternative is to decrease d—the deflector length. However, decreases in d require proportionate increases in f, the rotation frequency, to maintain operation at the same range of x values. These issues probably do not come into play until highly focused beams are available that allow operation with operating parameters that deliver high mass resolving power.

For typical operation of the instrument, the values of d and L are fixed. The ratio L/d determines the range of $x_L$, the lowest x value available for mass analysis. The electric field is preset to deflect the low mass ion to the edge of the detector. This setting depends only on L/d. The user decides the low mass limit, operating values that cause the low mass (i.e., fastest) ions to spend x rotations of the field passing through the deflector. The axial velocity of the low mass ion is determined by the accelerating potential, which is typically left at a fixed value. The transit time of the low mass ion through the deflector is determined by the axial velocity of the ion and the length of the deflector. The rotation frequency of the electric field is then chosen so that the transit time is x rotation periods. In summary, the low end of the mass range can be adjusted by changing the rotation period of the field. Alternatively, the accelerating potential can be varied to adjust the transit time of the low mass ion, leaving the rotation period fixed.

The value of $x_L$, determined by L/d, determines a value, $x_H$, for which all ions in the range $x_L$ to $x_H$ have mass resolving power at least as large as the boundaries of the region. $x_H=1-X_L$. The user may choose to analyze ions up to $x_H=0.81$, if she is willing to tolerate lower resolving power above $1-x_L$; the user may choose to analyze ions in the region $x_H$ between 0.81 and 1 if ions with x>1 are filtered out by a quadrupole mass filter. These ions strike the detector and can be included in the formation of a mass spectrum or simply ignored.

Each detected ion event is assigned an m/z value based upon its detected position and arrival time. The calculation is similar to the rotating magnetic field analyzer in many respects. The angular displacement of the ion (relative to the destination of ions just arriving at the deflector midpoint) gives the fractional part of the time of flight, measured in units of the rotation period. The radial displacement gives the integer part of the time of flight, also measured in units of the rotation period.

Determining the integer part of the time of flight involves mapping the ion onto the nearest ring of the spiral at a given angular displacement. The calculation involves the solution of a transcendental equation because the radius depends upon the transcendental function g. However, only a coarse solution is needed, so the answer can be computed by either a polynomial approximation of g or by table lookup.

Ions whose radial displacement is smaller than a specified high-mass limit are not included in the formation of the mass spectrum.

System Using a Rotating Electric Field

Returning to FIG. 8, the TOF mass spectrometer of system 800 can also be used to analyze a continuous beam of ions using a rotating electric field. System 800 includes ion source 810, accelerator 830, deflector 840, and two-dimensional detector 850. System 800 can also include processor 860 and mass filter 820.

Ion source 810 ionizes a sample producing a continuous beam of ions. Accelerator 830 receives the continuous beam of ions from mass filter 820. Accelerator 830 applies an electric field to the continuous beam of ions producing an accelerated beam of ions. Two-dimensional detector 850 records an arrival time and a two-dimensional arrival position of each ion in the accelerated beam of ions.

In various embodiments, system 800 further includes mass filter 820. Mass filter 820 receives the continuous beam of ions from ion source 810. Mass filter 820 admits ions with a desired range of mass-to-charge ratios and blocks ions outside the desired range producing a filtered beam. Mass filter 820 is a quadrupole, for example. Accelerator 830 receives the filtered beam of ions from mass filter 820. Accelerator 830 applies an electric field to the filtered beam of ions producing the accelerated beam of ions.

Deflector 840 is located between accelerator 830 and two-dimensional rectangular detector 850. Deflector 840 receives the accelerated beam from accelerator 830. Deflector 840 applies a rotating electric field to the accelerated beam to separate ions with different mass-to-charge ratios in the accelerated beam over an area of two-dimensional detector 850. The separation includes both a radial and an angular component. Each component is a function of the mass-to-charge ratio of the separated ions.

In various embodiments, system 800 is operated to send accelerated ions of a target range of mass-to-charge ratios through deflector 840 with transit times of at least 0.2 rotation periods of the rotating field and up to one period of the rotating field to achieve radial separation of the accelerated ions based upon differences in the magnitude of the time-averaged field, where the average for each ion is taken over its transit time.

In various embodiments, the rotating electric field separates ions in the accelerated beam by electric deflection so that at any given instant of time the ions of the accelerated beam are arranged in a spiral pattern on two-dimensional detector 850. Accelerated ions of increasing mass-to-charge ratio are separated monotonically along the spiral pattern inward toward the center of the spiral pattern.

In various embodiments, the mass range of separated ions that is recorded by two-dimensional detector 850 and the mass resolving power of two-dimensional detector 850 are determined by the following operating parameters: the kinetic energy per charge applied by the accelerator, the period of the rotating electric field, the field strength of the rotating electric field, the length of the region over which the electric field is applied, and the distance between deflector 840 and two-dimensional detector 850.

In various embodiments, the operating parameters are chosen to provide a separation of adjacent rings in the spiral pattern in which ions are arranged on two-dimensional detector 850 at any given instant time no smaller than the diameter of the focused beam on two-dimensional detector 850.

In various embodiments, processor 860 is in communication with accelerator 830, deflector 840, and two-dimensional rectangular detector 850. Processor 860 receives an arrival time and a two-dimensional arrival position for each ion impacting two-dimensional detector 840. Processor 860 calculates a time-of-flight for each ion impacting two-dimensional detector 840 from the arrival time and the two-dimensional arrival position. Processor 860 performs this calculation, for example, by combining both radial and angular components of the two-dimensional arrival position with respect to the direction of the accelerated beam. The radial component provides the integer part of the time-of-flight measured in units of the rotation period of the magnetic field and the angular component provides the fractional part of the time-of-flight.

Method Using a Rotating Electric Field

Figure 14:
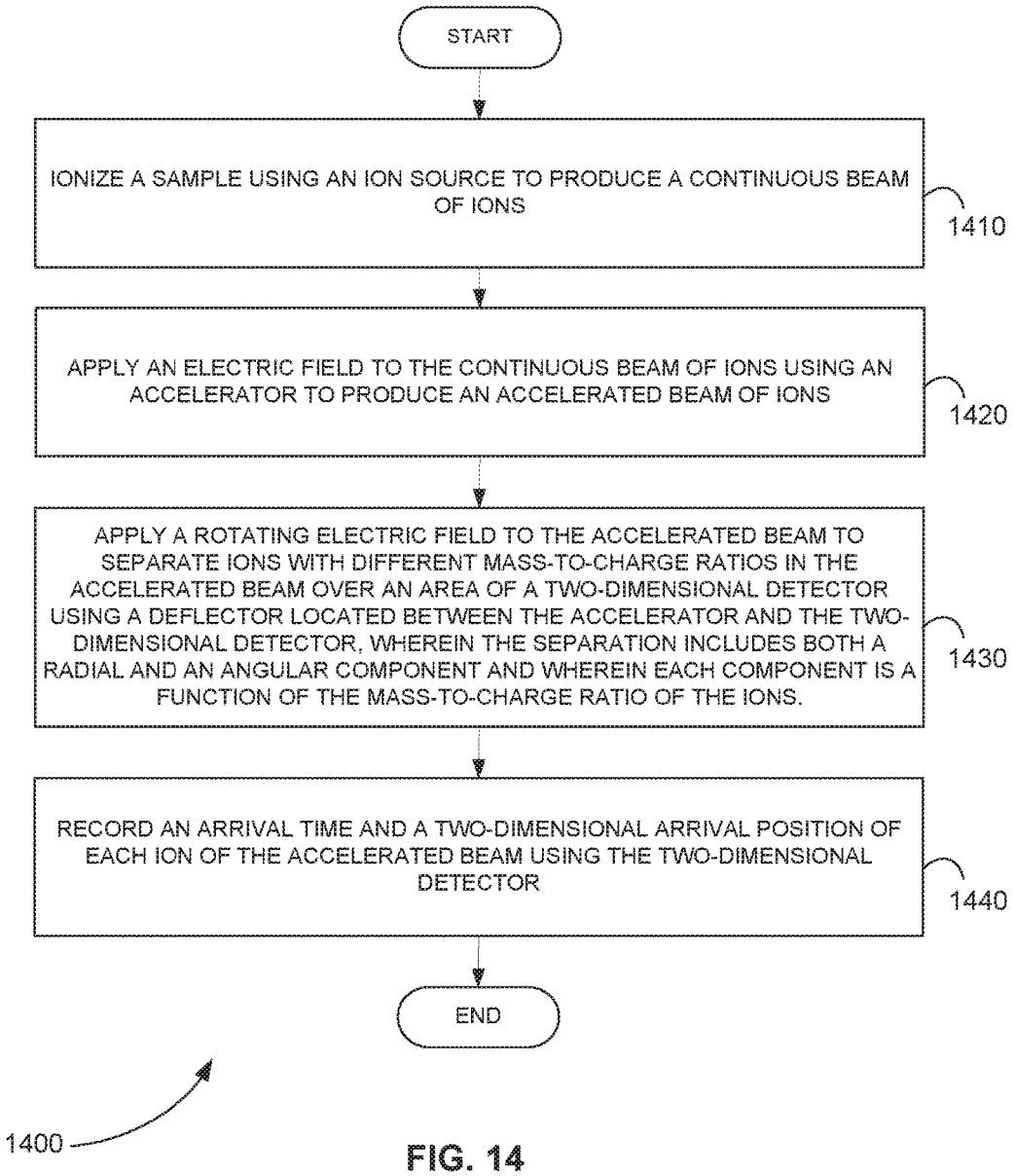
FIG. 14 is an exemplary flowchart showing a method for analyzing the time-of-flight of a continuous beam of ions using a rotating electric field, in accordance with various embodiments.

FIG. 14 is an exemplary flowchart showing a method 1400 for analyzing the time-of-flight of a continuous beam of ions using a rotating electric field, in accordance with various embodiments.

In step 1410 of method 1400, a sample is ionized using an ion source to produce a continuous beam of ions.

In step 1420, an electric field is applied to the continuous beam of ions using an accelerator to produce an accelerated beam of ions.

In step 1430, a rotating electric field is applied to the accelerated beam to separate ions with different mass-to-charge ratios in the accelerated beam over an area of a two-dimensional detector using a deflector located between the accelerator and the two-dimensional detector. The separation includes both a radial and an angular component, where each component is a function of the mass-to-charge ratio of the separated ions.

In step 1440, an arrival time and a two-dimensional arrival position of each ion of the accelerated beam are recorded using the two-dimensional detector.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A time-of-flight mass (TOF) spectrometer for analyzing a continuous beam of ions using a rotating magnetic field, comprising:

an ion source that ionizes a sample producing a continuous beam of ions;

an accelerator that receives the continuous beam and applies an electric field to the continuous beam of ions producing an accelerated beam of ions;

a two-dimensional detector that records an arrival time and a two-dimensional arrival position of each ion of the accelerated beam impacting the two-dimensional detector; and a deflector located between the accelerator and the two-dimensional detector that receives the accelerated beam and applies a rotating magnetic field to the accelerated beam to separate ions with different mass-to-charge ratios in the accelerated beam over an area of the two-dimensional detector, wherein the rotating magnetic field is rotated at a constant frequency.

2. The TOF mass spectrometer of claim 1, wherein the deflector comprises coils of wire wrapped around a cylindrical core and receives the accelerated beam of ions through the center of the core.

3. The TOF mass spectrometer of claim 1, wherein the rotating magnetic field separates ions in the accelerated beam by magnetic deflection so that at any given instant the ions of the accelerated beam are arranged in a spiral pattern on the two-dimensional detector, and wherein ions of increasing mass-to-charge ratio are separated monotonically along the spiral pattern inward toward the center of the spiral pattern.

4. The TOF mass spectrometer of claim 1, wherein the mass range of ions that are recorded by the two-dimensional detector and the mass resolving power of the two-dimensional detector are determined by the following operating parameters: the kinetic energy per charge applied by the accelerator, the period of the rotating magnetic field, the field strength of the rotating magnetic field, the length of the region over which the magnetic field is applied, and the distance between the deflector and the two-dimensional detector.

5. The TOF mass spectrometer of claim 1, further comprising a processor in communication with the accelerator, the deflector, and the two-dimensional detector that receives an arrival time and a two-dimensional arrival position for each ion impacting the two-dimensional detector and, calculates a time-of-flight for each ion impacting the two-dimensional detector from the arrival time and the two-dimensional arrival position.

6. The TOF mass spectrometer of claim 5, wherein the processor calculates a time-of-flight for each ion impacting the two-dimensional detector from the arrival time and the two-dimensional arrival position by combining both radial and angular components of the two-dimensional arrival position with respect to the direction of the accelerated beam, wherein the radial component provides the integer part of the time-of-flight measured in units of the rotation period of the magnetic field, and the angular component provides the fractional part of the time-of-flight.

7. The TOF mass spectrometer of claim 1, wherein the deflector further applies a rotating electric field to the accelerated beam that increases the deflection of each ion in the accelerated beam by the same radial displacement.

8. A method for analyzing the time-of-flight of a continuous beam of ions using a rotating magnetic field, comprising:

ionizing a sample using an ion source to produce a continuous beam of ions;

applying an electric field to the continuous beam of ions using an accelerator to produce an accelerated beam of ions;

applying a rotating magnetic field to the accelerated beam to separate ions with different mass-to-charge ratios in the accelerated beam over an area of a two-dimensional detector using a deflector located between the accelerator and the two-dimensional detector, wherein the rotating magnetic field is rotated at a constant frequency; and recording an arrival time and a two-dimensional arrival position of each ion of the accelerated beam using the two-dimensional detector.

9. A time-of-flight mass (TOF) spectrometer for analyzing a continuous beam of ions using a rotating electric field, comprising:

an ion source that ionizes a sample producing a continuous beam of ions;

an accelerator that receives the continuous beam and applies an electric field to the continuous beam of ions producing an accelerated beam of ions;

a two-dimensional detector that records an arrival time and a two-dimensional arrival position of each ion of the accelerated beam impacting the two-dimensional detector; and a deflector located between the accelerator and the two-dimensional detector that receives the accelerated beam and applies a rotating electric field to the accelerated beam to separate ions with different mass-to-charge ratios in the accelerated beam over an area of the two-dimensional detector, wherein the separation includes both a radial component and an angular component, wherein each component is a function of the mass-to-charge ratio of the ions, and wherein the rotating magnetic field is rotated at a constant frequency.

10. The TOF mass spectrometer of claim 9, wherein the TOF mass spectrometer is operated to send accelerated ions of a target range of mass-to-charge ratios through the deflector with transit times of at least 0.2 rotation periods of the rotating field and up to one period of the rotating field to achieve radial separation of the accelerated ions based upon differences in the magnitude of the time-averaged field, where the average for each ion is taken over its transit time.

11. The TOF mass spectrometer of claim 9, wherein the rotating electric field separates ions in the accelerated beam by electric deflection so that at any given instant of time the ions of the accelerated beam are arranged in a spiral pattern on the two-dimensional detector, and wherein ions of increasing mass-to-charge ratio are separated monotonically along the spiral pattern inward toward the center of the spiral pattern.

12. The TOF mass spectrometer of claim 9, wherein the mass range of separated ions that is recorded by the two-dimensional detector and the mass resolving power of the two-dimensional detector are determined by the following operating parameters: the kinetic energy per charge applied by the accelerator, the period of the rotating electric field, the field strength of the rotating electric field, the length of the region over which the electric field is applied, and the distance between the deflector and the two-dimensional detector.

13. The TOF mass spectrometer of claim 11, wherein the operating parameters are chosen to provide a separation of adjacent rings in the spiral pattern in which separated ions are arranged on the two-dimensional detector at any given instant of time no smaller than the diameter of a focused beam on the two-dimensional detector.

14. The TOF mass spectrometer of claim 9, further comprising a processor in communication with the accelerator, the deflector, and the two-dimensional detector that receives an arrival time and a two-dimensional arrival position for each ion impacting the two-dimensional detector and, calculates a time-of-flight for each ion impacting the two-dimensional detector from the arrival time and the two-dimensional arrival position.

15. The TOF mass spectrometer of claim 9, wherein the processor calculates a time-of-flight for each ion impacting the two-dimensional detector from the arrival time and the two-dimensional arrival position by combining both radial and angular components of the two-dimensional arrival position with respect to the direction of the accelerated beam, wherein the radial component provides the integer part of the time-of-flight measured in units of the rotation period of the electric field, and wherein the angular component provides the fractional part of the time-of-flight.

16. The TOF mass spectrometer of claim 9, wherein the TOF mass spectrometer further comprises a mass filter located between the ion source and the accelerator that receives the continuous beam and admits ions with a desired range of mass-to-charge ratios and blocks ions outside the desired range producing a filtered beam of ions and, wherein the accelerator receives the filtered beam and applies an electric field to the filtered beam producing the accelerated beam of ions.

17. A method for analyzing the time-of-flight of a continuous beam of ions using a rotating electric field, comprising:

ionizing a sample using an ion source to produce a continuous beam of ions;

applying an electric field to the continuous beam of ions using an accelerator to produce an accelerated beam of ions;

applying a rotating electric field to the accelerated beam to separate ions with different mass-to-charge ratios in the accelerated beam over an area of a two-dimensional detector using a deflector located between the accelerator and the two-dimensional detector where the separation includes both a radial component and an angular component, wherein the radial component and the angular component are each a function of the mass-to-charge ratio of the separated ions, and wherein the rotating magnetic field is rotated at a constant frequency; and recording an arrival time and a two-dimensional arrival position of each ion of the accelerated beam using the two-dimensional detector.

* * * * *